US008204418B2

(12) United States Patent
Nakajima

(10) Patent No.: US 8,204,418 B2
(45) Date of Patent: Jun. 19, 2012

(54) FIXING DEVICE WITH SEPARATION MECHANISM AND IMAGE FORMING APPARATUS COMPRISING THE SAME

(75) Inventor: Eiji Nakajima, Osaka (JP)

(73) Assignee: Kyocera Mita Corporation (JP)

( * ) Notice: Subject to any disclaimer, the term of this patent is extended or adjusted under 35 U.S.C. 154(b) by 315 days.

(21) Appl. No.: 12/708,563

(22) Filed: Feb. 19, 2010

(65) Prior Publication Data

US 2010/0215413 A1 Aug. 26, 2010

(30) Foreign Application Priority Data

Feb. 26, 2009 (JP) ..... 2009-044266

(51) Int. Cl.
*G03G 15/20* (2006.01)

(52) U.S. Cl. ..... 399/323; 399/398; 399/399

(58) Field of Classification Search ..... 399/323, 399/398, 399

See application file for complete search history.

(56) References Cited

U.S. PATENT DOCUMENTS

| | | | | |
|---|---|---|---|---|
| 4,028,050 | A * | 6/1977 | Bar-on | 432/59 |
| 4,771,310 | A * | 9/1988 | Leo et al. | 399/323 |
| 5,548,389 | A * | 8/1996 | Bowler, Jr. | 399/406 |
| 6,085,064 | A * | 7/2000 | Nagase et al. | 399/399 |
| 6,208,827 | B1 * | 3/2001 | Aslam et al. | 399/323 |
| 7,974,560 | B2 * | 7/2011 | Nakajima et al. | 399/323 |
| 2001/0016134 | A1 * | 8/2001 | Park | 399/397 |
| 2005/0084302 | A1 * | 4/2005 | Masuda et al. | 399/322 |
| 2007/0116504 | A1 * | 5/2007 | Miller et al. | 399/398 |
| 2007/0280752 | A1 | 12/2007 | Uchida | |
| 2008/0101827 | A1 * | 5/2008 | Mori | 399/323 |
| 2008/0138124 | A1 * | 6/2008 | Kikuchi et al. | 399/323 |
| 2010/0014898 | A1 * | 1/2010 | Nakajima | 399/322 |
| 2010/0221047 | A1 * | 9/2010 | Nakajima et al. | 399/323 |
| 2011/0182631 | A1 * | 7/2011 | Soeda | 399/323 |
| 2012/0020681 | A1 * | 1/2012 | Naitoh et al. | 399/21 |

FOREIGN PATENT DOCUMENTS

| | | | |
|---|---|---|---|
| JP | 3788220 | | 6/2006 |
| JP | 2008224833 | A * | 9/2008 |
| JP | 2011191450 | A * | 9/2011 |

* cited by examiner

*Primary Examiner* — David Gray
*Assistant Examiner* — G. M. Hyder
(74) *Attorney, Agent, or Firm* — Gerald E. Hespos; Michael J. Porco

(57) ABSTRACT

A separation mechanism of a fixing device includes a first separation member arranged opposite the first region in a state apart from the first region by a first gap, a second separation member arranged opposite the second region in a state apart from the second region by a second gap and at a position different from that of the first separation member in a direction orthogonal to the convey direction of the paper, a first gap adjustment member capable of moving the first separation member relative to the first region of the fixing member to adjust the first gap, and a second gap adjustment member capable of moving the second separation member relative to the second region of the fixing member to adjust the second gap.

8 Claims, 12 Drawing Sheets

FIXING DEVICE WITH SEPARATION MECHANISM AND IMAGE FORMING APPARATUS COMPRISING THE SAME

BACKGROUND OF THE INVENTION

1. Field of the Invention

The present invention relates to a fixing device fixing a toner image onto a paper at a nip area formed between a fixing member and a pressing member, and also relates to image forming apparatuses comprising same.

2. Description of the Related Art

A fixing device of an image forming apparatus generally includes a fixing roller, or a fixing belt wound onto a fixing roller (fixing member), and a pressing roller (pressing member) that contacts the fixing member to form a nip area between the pressing roller and the fixing member, and a toner image on a paper that is conveyed in is thermally fixed onto the paper. With the fixing device, there are cases where a paper that has undergone the fixing process is discharged from the nip area while being stuck to the fixing member, and in these cases problems are caused such as paper jam.

To eliminate such problems, in a first technology for example, the fixing device is provided with a separation mechanism, which is configured so as to be capable of stripping from the fixing member the paper that has stuck to the fixing member after the fixing process. The separation mechanism is provided with a single separation plate (separation member) that extends in a longitudinal direction of the fixing roller in a state in which it is kept apart from the fixing roller by a predetermined gap, and a plurality of screw members that are arranged leaving a predetermined interval between each other in the longitudinal direction of the separation plate and that contact the separation plate. When a screw member is rotated, an amount of contact of the screw member against the separation plate changes, and the magnitude of the gap between the separation plate and the fixing roller changes. That is, in this separation mechanism, the gap between the separation plate and the fixing roller can be adjusted at multiple locations on the separation plate. And by setting this gap to a predetermined magnitude, the separation plate contacts the paper that has stuck to the fixing roller and is able to strip the paper from the fixing roller.

The separation plate of the first technology is configured from a single separation member, and therefore when adjustment is carried out of the gap between a single portion of the separation plate and the fixing roller by rotating any of the screw members, the magnitude of the gap between other portions of the separation plate and the fixing roller changes undesirably. And it is necessary to readjust the changed gap so that it achieves the predetermined magnitude. Unfortunately, in this way, with the separation mechanism of the first technology, time is required in adjusting the gap between the separation plate and the fixing roller.

SUMMARY OF THE INVENTION

Accordingly, in light of the above situation, an object of the present invention is to provide a fixing device having a separation member which makes it easy to adjust the gap formed between the separation member and the fixing roller, an also is to provide an image forming apparatus provided with such fixing device.

To achieve this object, a fixing device according to the present invention includes a fixing member, a pressing member held in contact with the fixing member to form a nip area therebetween, the fixing member and the pressing member operable to sandwich a paper, on which a toner image has been formed, at the nip area and fix the toner image onto the paper, and a separation mechanism arranged on a downstream side of the fixing member in a convey direction of the paper and capable of stripping from the fixing member the paper that has undergone a fixing process. The fixing member has a first region and a second region set in a direction orthogonal to the convey direction of the paper. The separation mechanism includes a first separation member arranged opposite the first region in a state apart from the first region by a first gap, a second separation member arranged opposite the second region in a state apart from the second region by a second gap and at a position different from that of the first separation member in a direction orthogonal to the convey direction of the paper, a first gap adjustment member capable of moving the first separation member relative to the first region of the fixing member to adjust the first gap, and a second gap adjustment member capable of moving the second separation member relative to the second region of the fixing member to adjust the second gap.

DETAILED DESCRIPTION OF THE PREFERRED EMBODIMENTS

Hereinafter, preferred embodiments for executing the present invention are described in detail while referencing the accompanying drawings.

Figure 1:
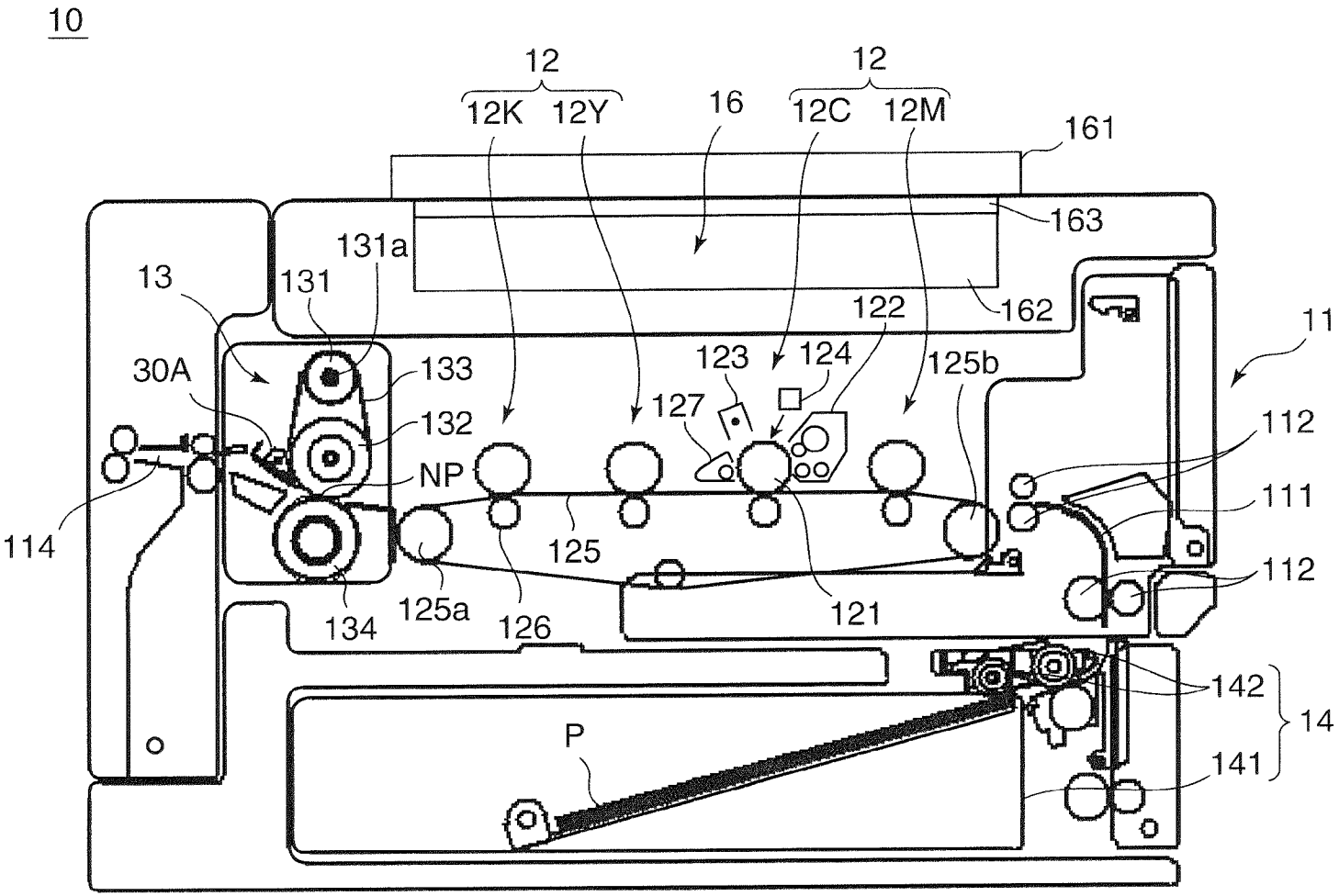
FIG. 1 is an explanatory diagram of a front cross-sectional view for describing an internal structure of an image forming apparatus in which is applied a fixing device according to a first embodiment of the present invention.

First, description is given using FIG. 1 regarding an outline of an image forming apparatus provided with a fixing device according to an embodiment of the present invention. FIG. 1 is an explanatory diagram of a front cross-sectional view for describing an embodiment of an internal structure of an image forming apparatus. An image forming apparatus 10 is used as a copier for color printing and includes as a basic configuration a apparatus main body 11, and an image reading device 16 that reads original images and which is provided at an upper section of the apparatus main body 11.

The apparatus main body 11 is internally provided with an image forming section 12, which forms a toner image based on image information of a document that has been read by the image reading device 16, a fixing device 13, which executes a fixing process on the toner image that has been transferred onto a paper P by the image forming section 12, and a paper storage section 14 that stores papers P.

The image reading device 16 includes a contact glass 163, which is installed on an upper surface of the image reading device 16 and on which the document is placed, a document presser 161, which is provided so as to be readily openable/closeable with respect to the contact glass 163 in order to press the document that has been placed on the contact glass 163, and an optical system unit 162, which is arranged below the contact glass 163 and reads an original image of the document on the contact glass 163. The optical system unit 162 is configured to scan an original surface of the document through the contact glass 163 from below using a light source and to read reflected light from the original surface using a CCD (charge coupled device). The image information of the document that has been read by the CCD undergoes digitalization and is outputted to an exposure device 124 of the image forming section 12.

The optical system unit 162 is specifically provided with components such as an unshown light source, a plurality of mirrors, a lens unit, and the CCD (charge coupled device). Light from the light source is reflected by the original surface, and this reflected light is inputted to the CCD as original information via the mirrors and the lens unit. The original information, which is inputted to the CCD as analog amounts, is converted to digital signals and stored in a predetermined storage device.

The image forming section 12 forms toner images on the papers P supplied from the paper storage section 14, and is constituted by a magenta unit 12M, a cyan unit 12C, a yellow unit 12Y, and a black unit 12K, which are successively arranged from an upstream side (right side of the page in FIG. 1) to a downstream side. Each of the units 12M, 12C, 12Y, and 12K includes a photosensitive drum 121 and a development device 122. Each of the photosensitive drums 121 receives a supply of toner from its corresponding development device 122 while rotating in a counterclockwise direction in FIG. 1. Unshown toner containers are provided inside the apparatus main body 11 in appropriate locations corresponding to the development devices 122, and toner from the toner containers is supplied to the development devices 122.

Each of the units 12M, 12C, 12Y, and 12K further includes a charger 123 and an exposure device 124 constituted by components such as an LED, which are arranged in positions directly above the photosensitive drums 121. The peripheral surface of each of the photosensitive drums 121 is charged uniformly by the charger 123. A corresponding laser beam for each color is radiated from each of the exposure devices 124 onto the peripheral surface of the charged photosensitive drums 121 based on image data that has been inputted by the image reading device 16. In this manner, electrostatic latent images are formed on the peripheral surfaces of the photosensitive drums 121. Then, a toner image is formed on each peripheral surface of the photosensitive drums 121 respectively by supplying toner of each color from the development devices 122 to the electrostatic latent images.

A conveying belt 125 is provided at a position below the photosensitive drums 121. The conveying belt 125 is a belt that conveys the papers P from the paper storage section 14 from the magenta unit 12M, which is on the most upstream side, to the black unit 12K, which is on the most downstream side, and is arranged spanning between a drive roller 125*a* and a driven roller 125*b*. The conveying belt 125 circles counterclockwise around the drive roller 125*a* and the driven roller 125*b* in synchronization with the photosensitive drums 121 in a state in which the conveying belt is pressed against the peripheral surface of each of the photosensitive drums 121 due to primary transfer rollers 126, which are provided corresponding to each of the photosensitive drums 121. A nip area is formed between each of the photosensitive drums 121 and its corresponding primary transfer roller 126 through which passes the paper P conveyed by the conveying belt 125.

When the paper P is guided from the paper storage section 14 through a paper convey path 111, which is described later, onto the conveying belt 125 and conveyed from the magenta unit 12M, which is on the most upstream side, to the black unit 12K, which is on the most downstream side, the toner image on the peripheral surface of each of the photosensitive drums 121 is transferred onto the paper P. Specifically, accompanying the circling of the conveying belt 125, first a magenta toner image is transferred onto the surface of the paper P by the photosensitive drum 121 of the magenta unit 12M. Following this, transfer of a cyan toner image is carried out in a superimposed manner by the photosensitive drum 121 of the cyan unit 12C onto a transfer position of the magenta toner image on the conveying belt 125. Thereafter, transfer of a yellow toner image by the yellow unit 12Y and transfer of a black toner image by the black unit 12K are carried out similarly in a superimposed manner. In this way, a color toner image is formed on the surface of the paper P.

A cleaning device 127 is provided at a leftward position in FIG. 1 for each of the photosensitive drums 121. The cleaning devices 127 perform cleaning by removing residual toner on the peripheral surface of the photosensitive drums 121 after the toner images have been transferred from the photosensitive drums 121 onto the paper P. The peripheral surface of the photosensitive drum 121, which has undergone the cleaning process by the cleaning device 127, moves toward the charger 123 for a new charging. Waste toner that has been removed from the peripheral surfaces of the photosensitive drums 121 by the cleaning devices 127 is collected in an unshown toner collection bottle by way of a predetermined route.

The paper storage section 14 is provided at a position underneath the image forming section 12 and the fixing section 13. The paper storage section 14 is provided with a paper tray 141 that stores a bundle of the papers P and is detachably mounted at the aforementioned underneath position. In FIG. 1, the paper tray 141 is provided as a single level, but two or more levels may be provided. The papers P are drawn out sheet by sheet from the paper tray 141 by the drive of a pickup roller 142. A paper P that has been drawn out is conveyed to the conveying belt 125 through the paper convey path 111.

The paper convey path 111 is a convey path that extends from a rightward position of the paper storage section 14 to a vicinity of the driven roller 125*b*. Conveying roller pairs 112 are provided in appropriate locations on the paper convey path 111, and the papers P from the paper storage section 14 are conveyed by the drive of the conveying roller pairs 112 to the conveying belt 125.

The fixing device 13 executes a fixing process on the toner image on the paper P that has been transferred by the image forming section 12. The fixing device 13 includes a heating roller 131, which is provided internally with a heater 131*a* as a heat source, a fixing roller 132 arranged in opposition to the heating roller 131, a fixing belt 133 provided spanning between the fixing roller 132 and the heating roller 131, and a pressing roller (pressing member) 134, which is arranged in opposition to the fixing roller 132 through the fixing belt 133. A nip area NP through which the papers P pass is formed between the fixing belt 133 and the pressing roller 134. The paper P, on which a toner image has been transferred, is pressed and sandwiched between the fixing roller 132 and the pressing roller 134 at the nip area NP while receiving heat from the fixing belt 133. In this way, a color toner image having a stabilized state is formed on the paper P. In the present embodiment, the fixing roller 132 and the fixing belt 133 constitute a fixing member.

There are cases where a paper P, after undergoing the fixing process at the nip area NP, is discharged from the nip area NP while being stuck to the fixing belt 133, and in these cases problems are caused such as paper jam. A separation mechanism 30A is provided in the fixing device 13 to eliminate such problems. The separation mechanism 30A is arranged on a downstream side of the fixing member in a convey direction T of the paper P (FIG. 2) and is configured to be capable of stripping the paper P from the fixing belt 133 in a case where the paper P has passed through the nip area NP while being stuck to the fixing belt 133 after the fixing process.

The paper P, on which a color image is adhered after the fixing process is completed, is discharged to an unshown paper discharge tray provided on a left side wall of the apparatus main body 11 by way of a paper discharge convey path 114, which is provided extending from the fixing section 13.

First Embodiment

Figure 2:
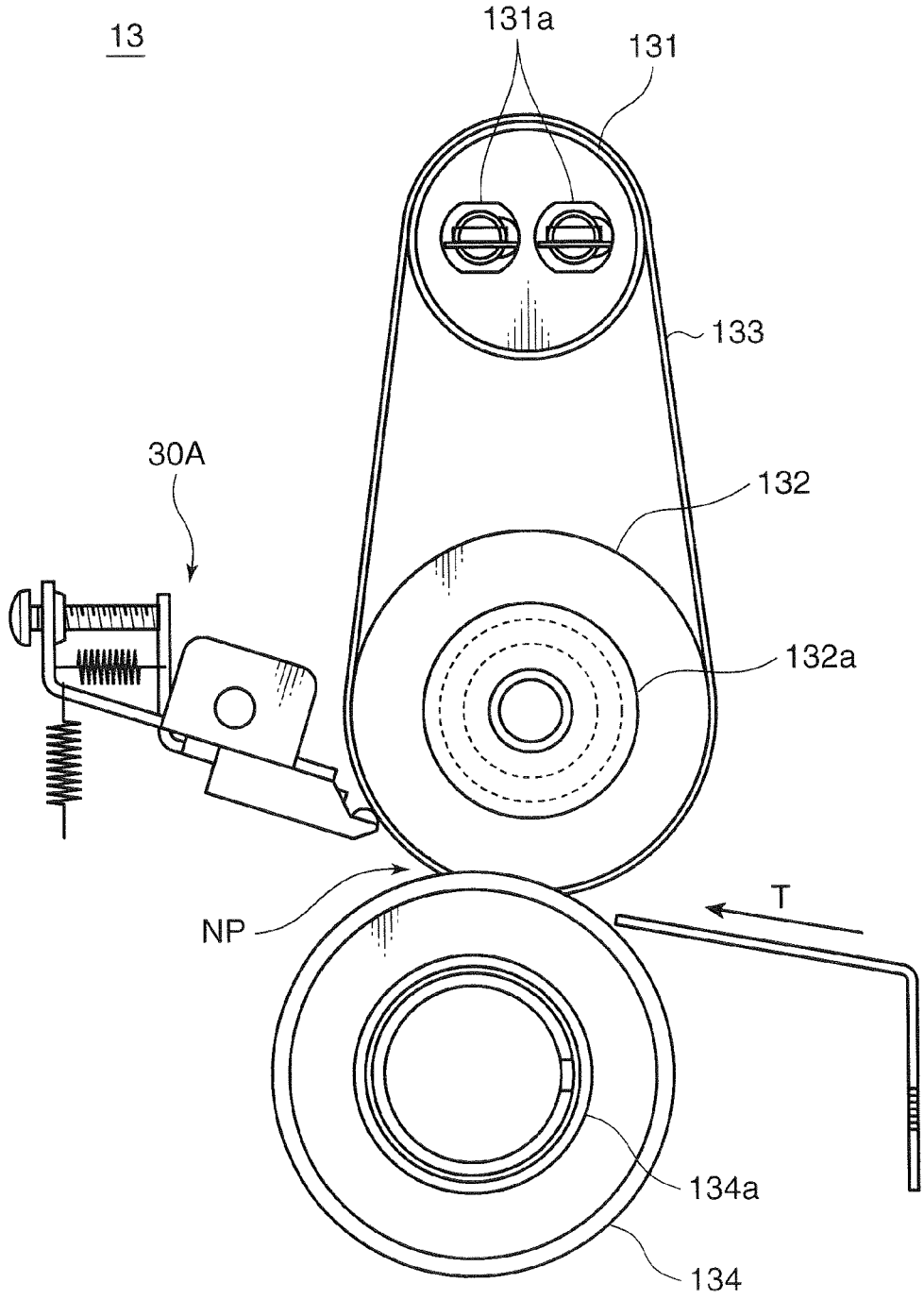
FIG. 2 is a front cross-sectional view explanatory diagram for describing main components of the fixing device according to the first embodiment.
Figure 3:
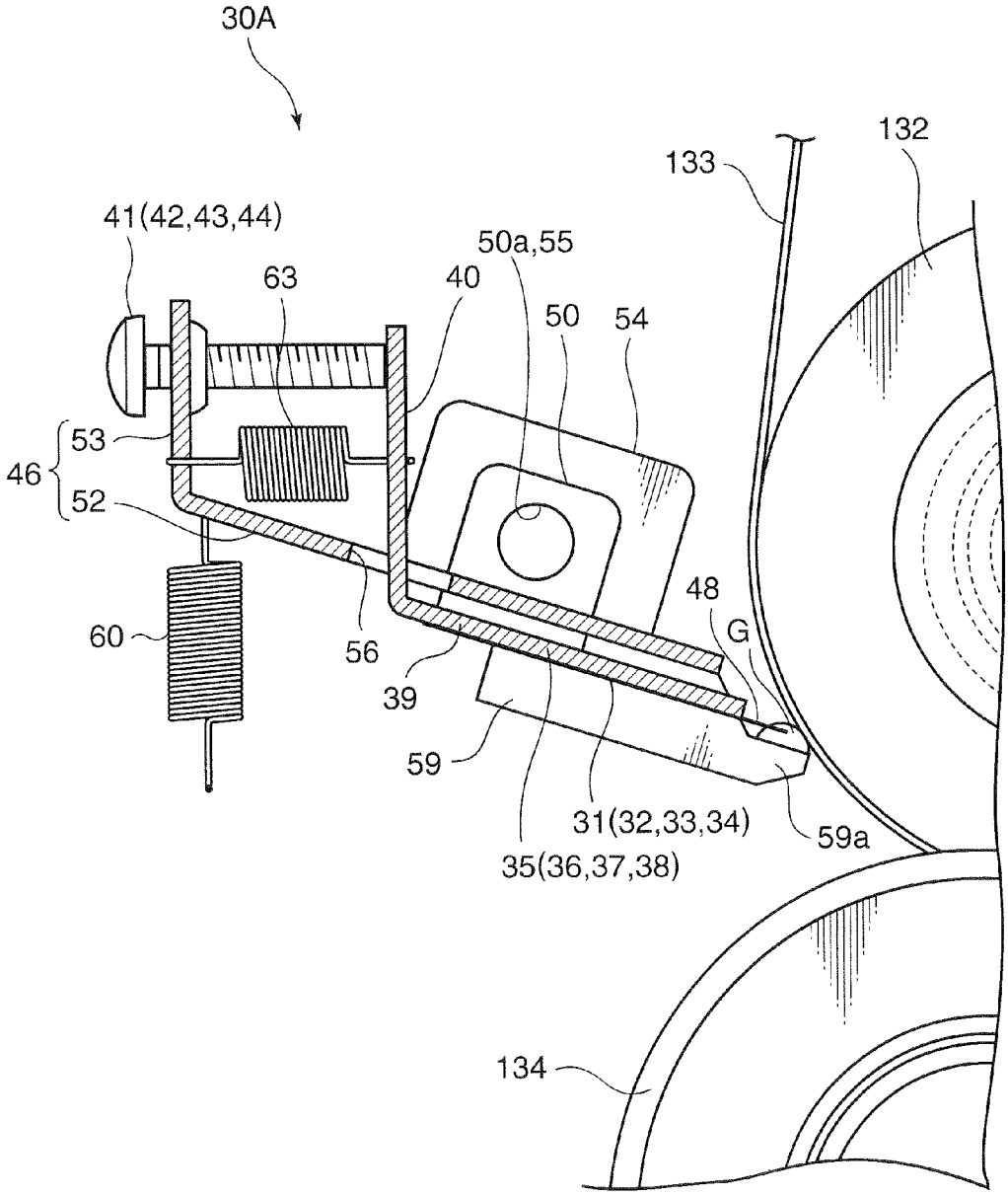
FIG. 3 is an enlarged view of a separation mechanism, which is one principal component of the fixing device shown in FIG. 2.

Hereinafter, description is given with reference to FIG. 2 and FIG. 3 regarding the fixing device 13 according to a first embodiment. FIG. 2 is a schematic diagram for describing main components of the fixing device 13. FIG. 3 is an enlarged view of the separation mechanism 30A, which is one of the principal components of the fixing device 13 shown in FIG. 2.

As stated earlier, the fixing device 13 includes the heating roller 131, the fixing roller 132, the fixing belt 133, which is provided spanning between the heating roller 131 and the fixing roller 132, the pressing roller 134, which is arranged in opposition to the fixing roller 132 through the fixing belt 133, and the separation mechanism. 30A, which is arranged in opposition to the fixing roller 132 through the fixing belt 133.

The heating roller 131 has an aluminum core and is a roller on which a fluorocarbon resin coating has been implemented on the core and that is internally provided with the heater 131*a*. The fixing roller 132 has an iron core and is a roller on which a silicone rubber has been applied on that core. The pressing roller 134 has an aluminum core and is a roller on which a silicone rubber has been applied on that core, and on which a PFA tube is further provided on the silicone rubber. The fixing belt 133 that is wound around the heating roller 131 and the fixing roller 132 has a nickel substrate, and is a belt on which a silicone rubber is provided on that substrate, and on which a PFA tube is further provided on the silicone rubber.

The heating roller 131, the fixing roller 132, and the pressing roller 134 are rollers whose longitudinal directions are directions orthogonal to a convey direction T (FIG. 2) in which the papers P are conveyed from the image forming section 12 to the nip area NP of the fixing device 13, and an unshown rotational shaft of the heating roller 131, a rotational shaft 132*a* of the fixing roller 132, and a rotational shaft 134*a* of the pressing roller 134 are set parallel to each other. A width dimension of the fixing belt 133 that is wound around the fixing roller 132 is set substantially equivalent or less than a longitudinal dimension of the fixing roller 132. The separation mechanism 30A is arranged at a downstream side from the fixing roller 132 and the pressing roller 134 in the paper convey direction T, that is, at a downstream side from the nip area NP.

As shown in FIG. 3, the separation mechanism 30A includes as main components a plurality of separation plates (separation members) 31 to 34, which are arrayed leaving a predetermined gap between each other in the longitudinal direction of the fixing roller 132, that is, a direction orthogonal to the paper convey direction T, a plurality of separation plate holders 35 to 38 to which the corresponding separation plates 31 to 34 are attached, gap adjustment members 41 to 44, which are arranged corresponding to the separation plate holders 35 to 38 and which cause the corresponding separation plate holders 35 to 38 to rotate, a support member 46 that supports the gap adjustment members 41 to 44, and a main body frame 47 (FIG. 4 and FIG. 5) that supports the separation plate holders 35 to 38 and the support member 46.

Figure 4:
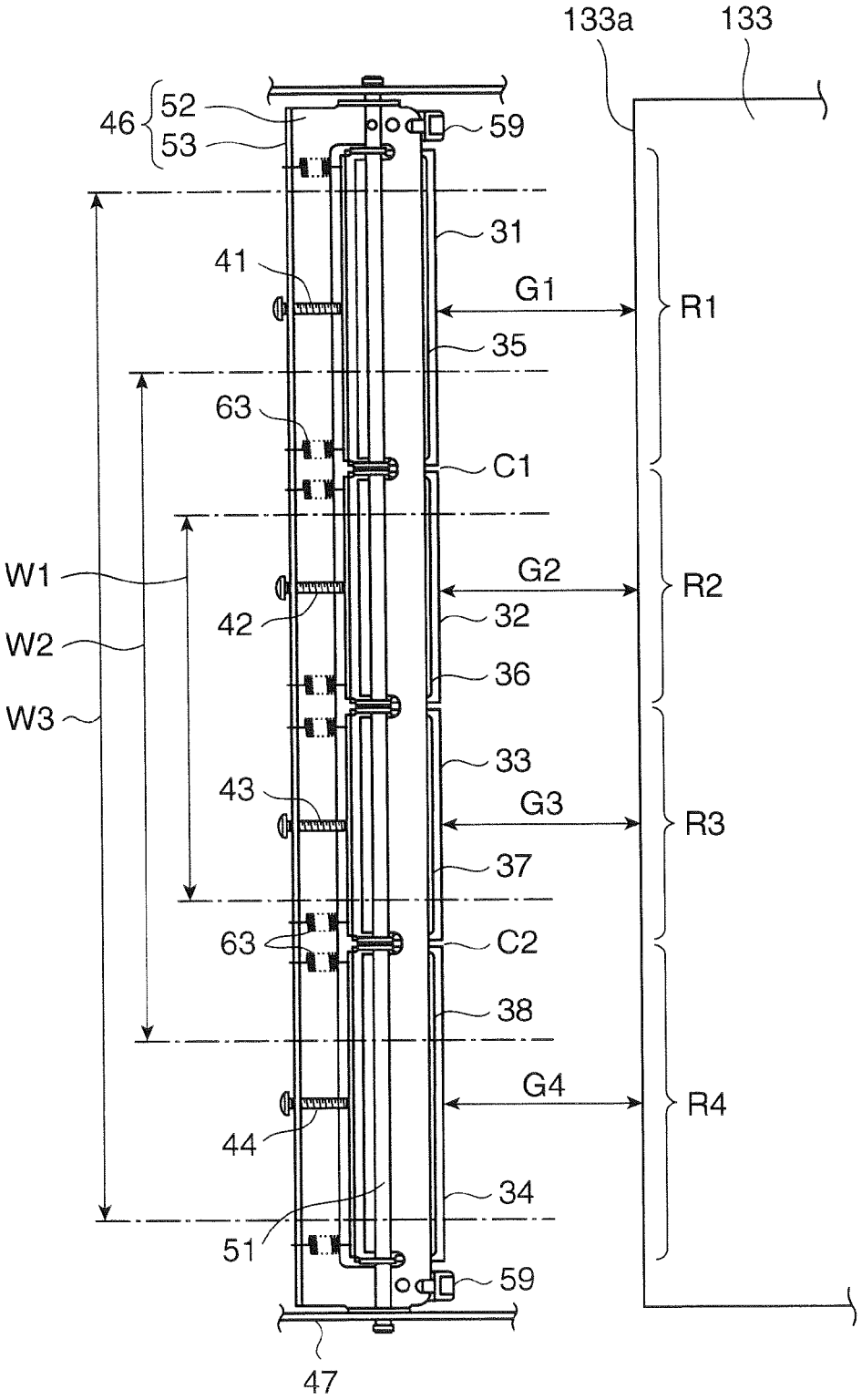
FIG. 4 is a top view of the separation mechanism shown in FIG. 3.
Figure 5:
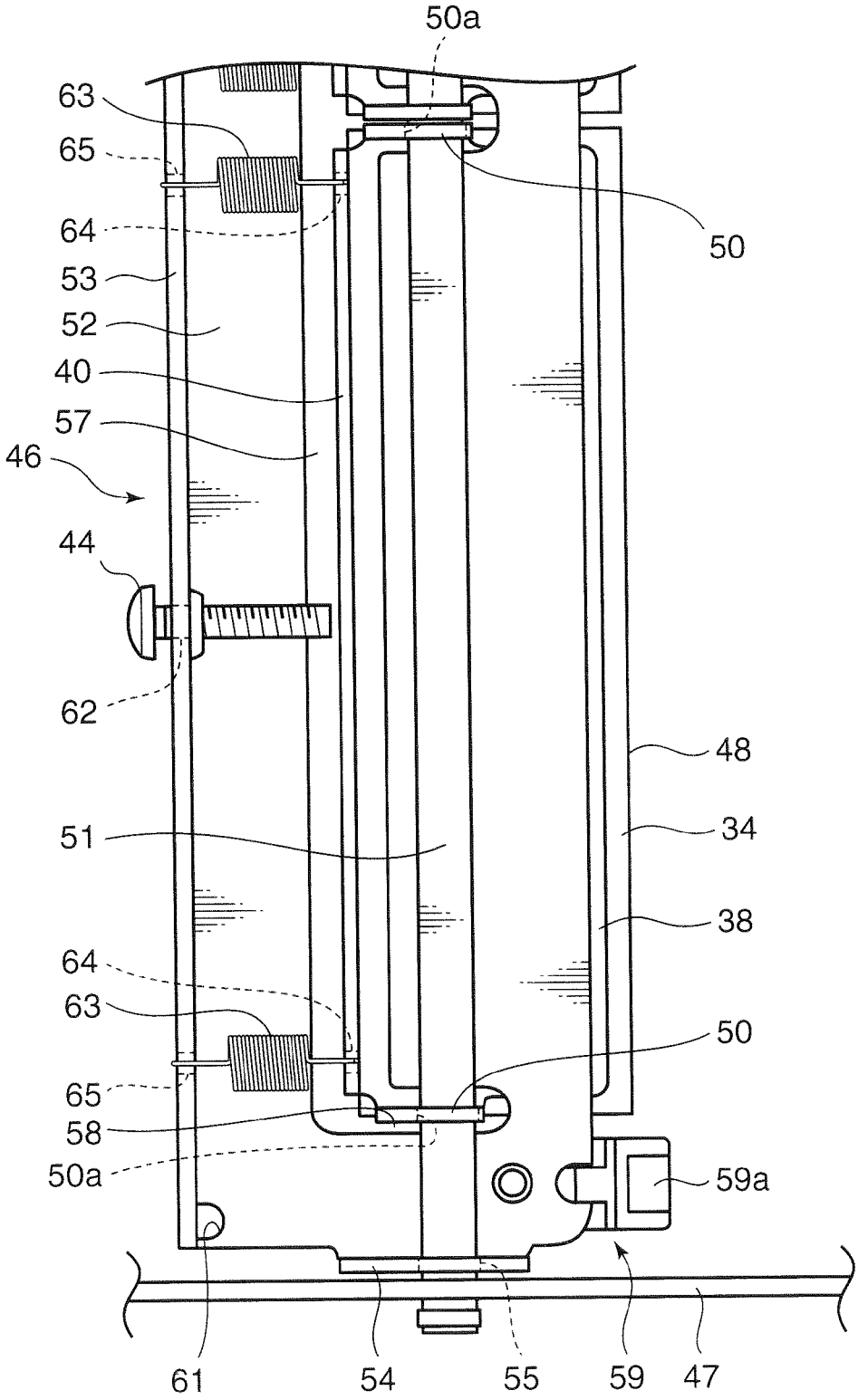
FIG. 5 is an enlarged top view of one portion of FIG. 4.
Figure 6:
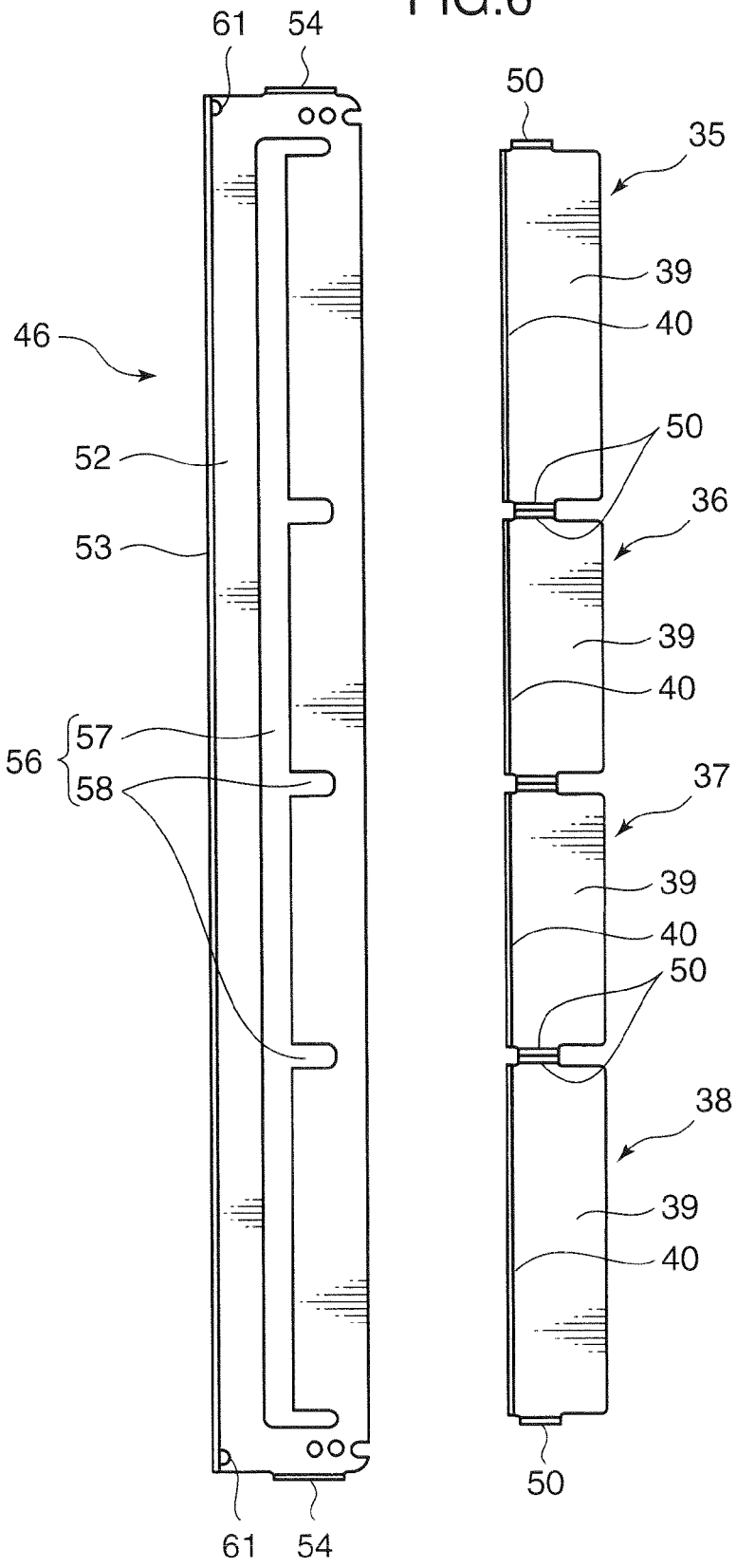
FIG. 6 is an exploded top view showing separation plate holders and support members of the separation mechanism.
Figure 7:
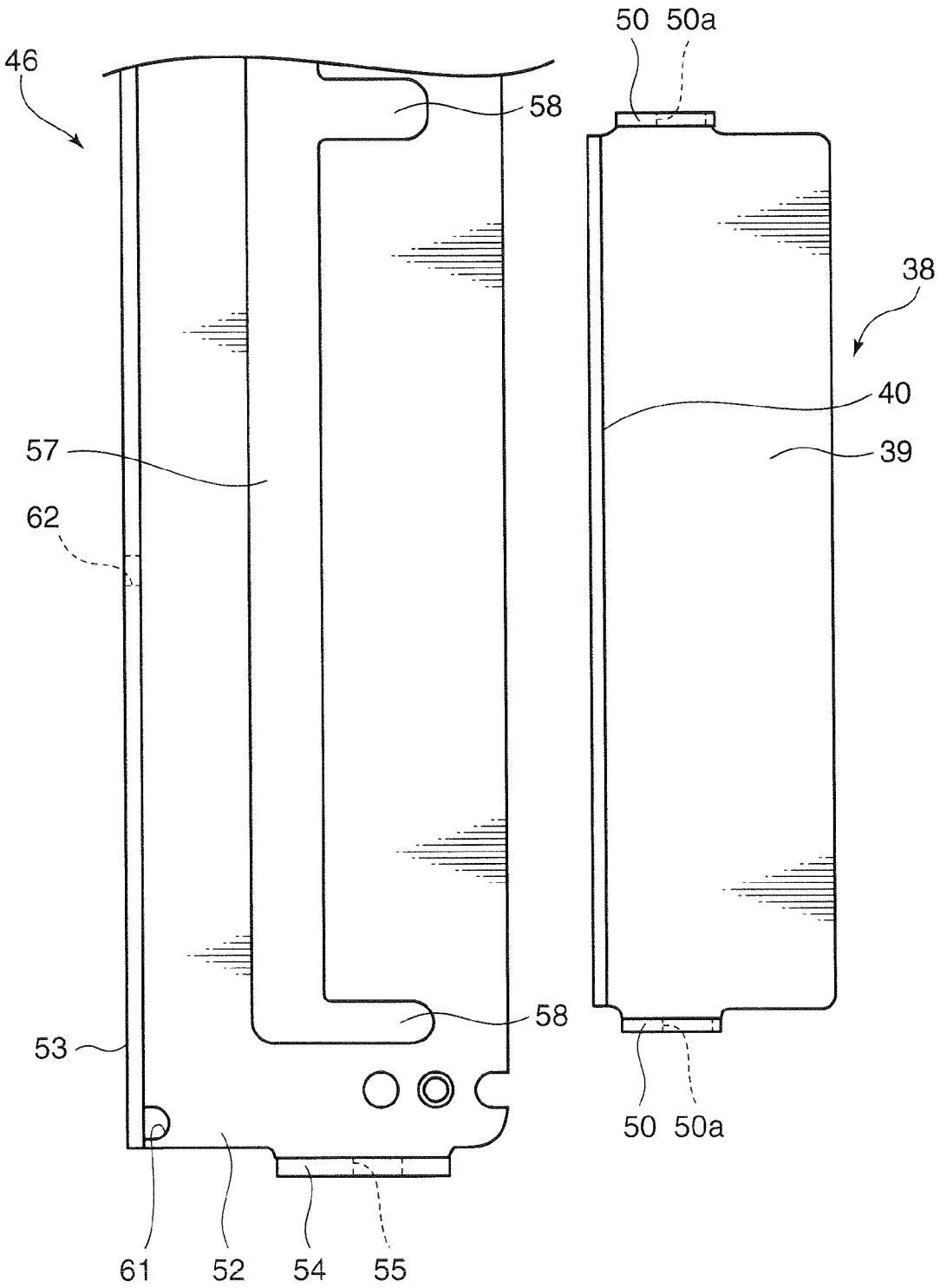
FIG. 7 is an enlarged top view of one portion of FIG. 6.

Hereinafter, detailed description is given with reference to FIG. 4 to FIG. 7 regarding each of the principal components of the separation mechanism 30A. FIG. 4 is a top view of the separation mechanism 30A, and FIG. 5 is an enlarged top view of one portion of FIG. 4. FIG. 6 is an exploded top view showing only the separation plate holders 35 to 38 and the support member 46, and FIG. 7 is an enlarged top view of one portion of FIG. 6.

In the present embodiment, as shown in FIG. 4 and FIG. 6, the four separation plate holders (first to fourth separation plate holders 35 to 38) are arrayed in the longitudinal direction of the fixing roller 132 (vertical direction in FIG. 4). Each of the separation plate holders 35 to 38 is a member whose cross section as viewed from the longitudinal direction of the fixing roller 132 forms a substantial L shape (FIG. 3), and is provided with a rectangular holder main body portion 39 that extends along the longitudinal direction of the fixing roller 132, and a rising wall (extended portion) 40 that rises from an edge (left edge in FIG. 6 and FIG. 7) extending along the longitudinal direction of the holder main body portion 39. It should be noted that in the diagrams, the first separation plate holder 35 and the fourth separation plate holder 38 have substantially equivalent dimensions, and the second separation plate holder 36 and the third separation plate holder 37 have substantially equivalent dimensions, but the dimensions of the first to fourth separation plate holders 35 to 38 may all be different or may be set to be equivalent.

As shown in FIG. 4 and FIG. 5, corresponding first to fourth separation plates 31 to 34 are attached at a bottom surface of each holder main body portion 39 of the first to fourth separation plate holders 35 to 38. Each of the first to fourth separation plates 31 to 34 is set having a thickness of approximately 0.2 mm and is a rectangular flat plate member on whose surface a fluororesin coating has been implemented. The first to fourth separation plates 31 to 34 are secured by welding for example to the corresponding first to fourth separation plate holders 35 to 38. The first to fourth separation plates 31 to 34 have an edge 48 (right edge in FIG. 4 and FIG. 5) that extends along the longitudinal direction of the fixing roller 132, and in a state in which the first to fourth separation plates 31 to 34 are welded and secured to the first to fourth separation plate holders 35 to 38, the right edge 48 protrudes by a predetermined distance from the lower surface of the corresponding holder main body portion 39 toward the peripheral surface of the fixing roller 132. And as shown in FIG. 3, each right edge 48 of the first to fourth separation plates 31 to 34 is in opposition to the surface 133*a* of the fixing belt 133 wound around the fixing roller 132 with a predetermined gap G, for example a gap of 0.3 to 0.5 mm. With the thus-configured first to fourth separation plates 31 to 34, in a case where a paper that has passed through the nip area NP and is discharged from the nip area NP while stuck to the surface 133*a* of the fixing belt 133, the paper can be stripped from the surface 133*a* of the fixing belt 133 by the right edges 48 contacting the paper that is stuck to the surface 133*a* of the fixing belt 133.

Furthermore, each holder main body portion 39 of the first to fourth separation plate holders 35 to 38 is provided with a front edge and a rear edge that are in opposition to each other in the longitudinal direction of the holder main body portions 39. A pivot support wall 50 that rises upwardly is provided at the front edge and the rear edge respectively, and a pivot support hole 50*a* (FIG. 5 and FIG. 7), through which a common pivot shaft 51 is inserted, is formed at each of the pivot support walls 50. The pivot support holes 50*a* of the holder main body portions 39 of the first to fourth separation plate holders 35 to 38 are set so as to be on the same axis. Accordingly, in a state in which the common pivot shaft 51 is inserted through all the pivot support holes 50*a*, the first to fourth separation plate holders 35 to 38 are able to rotate centered on the common pivot shaft 51. The common pivot shaft 51 is supported at both ends by the main body frame 47.

The ranges of rotation of the first to fourth separation plate holders 35 to 38 can be adjusted by the first to fourth gap adjustment members 41 to 44, which are provided corresponding to the first to fourth separation plate holders 35 to 38 respectively. As shown in FIG. 3 to FIG. 5, the gap adjustment members 41 to 44 are screw members for example, which are rotatably supported by the support member 46, and a end of each of the screw sections 41 to 44 abuts the rising wall 40 of the corresponding separation plate holders 35 to 38. Accordingly, by causing the gap adjustment members 41 to 44 to rotate, the corresponding separation plate holder 35 to 38 rotates centering on the common pivot shaft 51. And along with rotation of the separation plate holders 35 to 38, the gap G between the right edge 48 of the separation plates 31 to 34 secured to the separation plate holders 35 to 38 and the surface 133*a* of the fixing belt 133 changes. The range of change, that is, the magnitude of the gap G, is set to 0.3 to 0.5 mm as mentioned above.

In the present embodiment, four first to fourth separation plates 31 to 34 are used, and therefore as shown in FIG. 4, four regions R, for example, first to fourth regions R1 to R4 can be set on the surface 133*a* of the fixing belt 133 wound on the fixing roller 132 corresponding to the first to fourth separation plates 31 to 34. Specifically, the first separation plate 31 is arranged in opposition to the first region R1 in a state apart from the first region R1 by a first gap G1, the second separation plate 32 is arranged in opposition to the second region R2 in a state apart from the second region R2 by a second gap G2, the third separation plate 33 is arranged in opposition to the third region R3 in a state apart from the third region R3 by a third gap G3, and the fourth separation plate 34 is arranged in opposition to the fourth region R4 in a state apart from the fourth region R4 by a fourth gap G4. The width dimension of each of the first to fourth regions R1 to R4 is set so as to be substantially equivalent to the longitudinal dimension of the corresponding first to fourth separation plates 31 to 34. Accordingly, in the present embodiment, the gap G between the separation plates 31 to 34 and the fixing belt 133 can be set in four locations.

As shown in FIG. 3, FIG. 6, and FIG. 7, the support member 46 that rotatably supports the first to fourth gap adjustment members 41 to 44 is a member whose cross section as viewed from the longitudinal direction of the fixing roller 132 forms a substantial L shape, and is provided with a main body portion 52 constituted by a substantially rectangular flat plate member that extends along the longitudinal direction of the fixing roller 132, and the rising wall 53 that rises upward from an edge (left edge in the diagrams) extending along the longitudinal direction of the main body portion 52.

At ends of the support wall 52 in the longitudinal direction are formed a pair of pivot support walls 54, 54 that extend upward from the ends. Pivot support holes 55, which are set on the same axis as each other and which are set on the same axis as the pivot support holes 50*a* of the first to fourth separation plate holders 35 to 38, are formed at the pair of pivot support walls 54, 54. Accordingly, in a state in which the common pivot shaft 51 is inserted into the pivot support holes 55 of the support member 46 and the pivot support holes 50*a* of the first to fourth separation plate holders 35 to 38, the support member 46 can rotate on the same shaft as the first to fourth separation plate holders 35 to 38.

Furthermore, an elongated slit 56, which extends from the vicinity of one end of the main body portion 52 in the longitudinal direction to the vicinity of the other end, is formed on the main body portion 52 of the support member 46. The slit 56 is constituted by a first slit section 57, which extends in the longitudinal direction of the main body portion 52, and second slit sections 58, which extend from the first slit section 57 in a direction substantially orthogonal to the longitudinal direction of the main body portion 52. In FIG. 6, five second slit sections 58 are formed leaving predetermined gaps between each other. The gaps between the second slit sections 58 are determined appropriately according to the longitudinal dimensions of the first to fourth separation plate holders 35 to 38.

Furthermore, as shown in FIG. 4 and FIG. 5, abutting members 59 are attached at lower surfaces on the one end and the other end of the main body portion 52 so as to not interfere with the first separation plate 31 and the fourth separation plate 34. The ends 59*a* of the abutting members 59 protrude rightward from the right edge 48 of the first to fourth separation plates 31 to 34 and are held in a state in contact with the fixing roller 132 through the fixing belt 133. The ends 59*a* of the abutting members 59 are set in position so as to contact regions outside of the longitudinal end regions of the fixing roller 132, that is, outside a maximum paper region W3 (FIG. 4), which is described later, in the nip area NP between the fixing roller 132 and the pressing roller 134.

And the abutting members 59 are held in a state contacting the longitudinal ends of the fixing roller 132 by biasing members 60. The biasing members 60 are constituted by two spring members arranged under the support member 46 as shown in FIG. 3 at positions corresponding to the one end and the other end of the main body portion 52 of the support member 46. The one end and the other end of the main body portion 52 are provided with an engagement hole 61 respectively, which are formed in the vicinity of a left edge opposite to the right edge where the abutting members 59 are attached. One end of each spring member 60 is engaged into the engagement hole 61, and the other end is latched to an unshown predetermined member of the fixing device. Due to these spring members 60, the support member 46 is pulled downward and rotates centering on the common pivot shaft 51, and therefore the ends 59*a* of the abutting members 59 are held in a state contacting the fixing roller 132 through the fixing belt 133.

The abutting members 59 abut the longitudinal ends of the fixing roller 132, and therefore even in a case where the fixing roller 132 or the fixing belt 133 undergo thermal expansion or oscillation during the fixing process, the abutting members 59 follow the deformation of the fixing roller 132 and fixing belt 133 caused by the thermal expansion or oscillation, and rotate centering on the common pivot shaft 51. Due to this, the distances between the first to fourth separation plates 31 to 34 and the surface 133*a* of the fixing belt 133 (fixing roller 132) can be maintained at a magnitude in a range of the aforementioned 0.3 to 0.5 mm.

Furthermore, a plurality (four in FIG. 4) of pass-through holes 62 are formed in the rising wall 53 of the support member 46 leaving a predetermined gap between each other in the longitudinal direction of the main body portion 52. The aforementioned first to fourth gap adjustment members (screw members) 41 to 44 are rotatably inserted into these four pass-through holes 62. A tip portion of each of the screw members 41 to 44 contacts the rising wall 40 of the corresponding first to fourth separation plate holders 35 to 38 as described earlier.

A plurality of biasing members 63 are disposed between the rising wall 53 of the support member 46 and the rising wall 40 of the first to fourth separation plate holders 35 to 38. Specifically, as shown in FIG. 3 to FIG. 5, two biasing members 63, for example spring members, are arranged between the rising wall 40 of the separation plate holders 35 to 38 and the rising wall 53 of the support member 46 corresponding to the first to fourth separation plate holders 35 to 38 respectively. The two spring members 63 corresponding to the separation plate holders 35 to 38 are arranged in between the gap adjustment members 41 to 44 that contact the rising wall 40 of the separation plate holders 35 to 38. As shown in FIG. 5, one end of each of the spring members 63 is engaged into the engagement holes 64 formed in the rising wall 40 of the separation plate holders 35 to 38, and the other end is engaged into the engagement holes 65 formed in the rising wall 53 of the support member 46.

Due to these biasing members 63, each rising wall 40 of the first to fourth separation plate holders 35 to 38 is pulled toward the rising wall 53 of the support member 46, and therefore the first to fourth separation plate holders 35 to rotate centering on the common pivot shaft 51 (counterclockwise rotation in FIG. 3). Due to this counterclockwise rotation, the separation plates 31 to 34, which are secured at the separation plate holders 35 to 38, move toward the surface 133*a* of the fixing belt 133. However, since the corresponding first to fourth gap adjustment members 41 to 44 contact the rising walls 40 of the first to fourth separation plate holders 35 to 38, the counterclockwise rotation of the first to fourth separation plate holders 35 to 38 is stopped, and movement of the separation plates 31 to 34 to the fixing belt 133 is regulated. By adjusting the rotation amounts of the first to fourth separation plate holders 35 to 38 in this manner using the first to fourth gap adjustment members 41 to 44, the gaps G (G1 to G4) between the separation plates 31 to 34 and the fixing belt 133 can be maintained at a magnitude in a range of the aforementioned 0.3 to 0.5 mm.

The first to fourth separation plate holders 35 to 38 are positioned with respect to the support member 46 in a following manner. First, each of the holder main body portions 39 is put through the first slit section 57 of the support member 46 and pivot support wall 50 of each of the holder main body portions 39 is put through the second slit sections 58. Next, the common pivot shaft 51 is inserted into the pivot support holes 50*a* of the holder main body portions 39 and the pivot support holes 55 of the support member 46. Then, the rotation amounts of the first to fourth screw members 41 to 44, which are rotatably supported by the rising wall 53 of the support member 46, are adjusted appropriately to cause the ends of the first to fourth screw members 41 to 44 to contact the rising wall 40 of the first to fourth separation plate holders 35 to 38. In this manner, the first to fourth separation plate holders 35 to 38 are positioned with respect to the support member 46.

Incidentally, paper passing regions through which the papers pass are set in the nip area NP between the fixing belt 133 and the pressing roller 134 in accordance with the size of the paper in the longitudinal direction of the fixing roller 132. In order to simplify description, FIG. 4 shows a state in which a top view of the separation mechanism and the paper passing regions are overlaid. As shown in this diagram, a minimum paper region W1, an intermediate paper region W2, and a maximum paper region W3 are given as paper passing regions, which are set for when a minimum size paper, an intermediate size paper, and a maximum size paper are to pass through the nip area NP. In the present embodiment, the position settings of the first to fourth separation plates 31 to 34 are carried out according to the minimum paper region W1, the intermediate paper region W2, and the maximum paper region W3.

Specifically, in a state in which the first to fourth separation plates 31 to 34, which are secured to the first to fourth separation plate holders 35 to 38, are arrayed as shown in FIG. 4, a first and a second gap C1 and C2 are present between the first separation plate 31 and the second separation plate 32, and between the third separation plate 33 and the fourth separation plate 34 respectively. Even though the first gap C1 and the second gap C2 are present, the longitudinal dimensions of the first to fourth separation plates 31 to 34 are set such that the first gap C1 and the second gap C2 are present in positions displaced from the longitudinal ends of the minimum paper region W1 and the longitudinal ends of the intermediate paper region W2. More specifically, one end of the separation plate 31 and one end of the adjacent separation plate 32, which ends are opposed to each other in the longitudinal direction of the fixing belt 133 through the first gap C1, are set at positions corresponding to positions displaced from the longitudinal ends of the minimum paper region W1 and also from the longitudinal ends of the intermediate paper region W2. Similarly, one end of the separation plate 33 and one end of the adjacent separation plate 34, which ends are opposed to each other in the longitudinal direction of the fixing belt 133 through the first gap C2, are set at positions corresponding to positions displaced from the longitudinal ends of the minimum paper region W1 and also from the longitudinal ends of the intermediate paper region W2. In this way, it is possible to prevent minimum size and intermediate size papers from catching on the first gap C1 and the second gap C2 when stripping the paper from the fixing belt 133 using the first to fourth separation plates 31 to 34. As a result, occurrences of paper jam of minimum and intermediate size papers can be prevented.

It should be noted that gaps are also present between the first separation plate 31 and the one abutting member 59 and between the fourth separation plate 34 and the other abutting member 59 respectively, but these gaps are set such that they are present in a position displaced from the longitudinal ends of the maximum paper region W3, and therefore it is possible to prevent maximum size papers from catching on these gaps when stripping the paper from the fixing belt 133 using the first and fourth separation plates 31 and 34. In this way, occurrences of paper jam of maximum size papers can be prevented.

With the thus-configured separation mechanism 30A, the first to fourth gap adjustment members (screw members) 41 to 44 are provided corresponding to the first to fourth separation plates 31 to 34 respectively, and therefore the first to fourth separation plates 31 to 34 can be moved individually with respect to the fixing belt 133 so that the first to fourth gaps G1 to G4 between the first to fourth separation plates 31 to 34 and the first to fourth regions R1 to R4 of the fixing belt 133 achieve a magnitude in the range of 0.3 to 0.5 mm. As a result, adjustment of the gaps G between the separation plate (the first to fourth separation plates 31 to 34) and the fixing belt 133 become easy compared to conventional configurations in which the gap between the separation plate and the fixing belt is adjusted by causing a plurality of screw members to contact a single separation plate.

Second Embodiment

Figure 8:
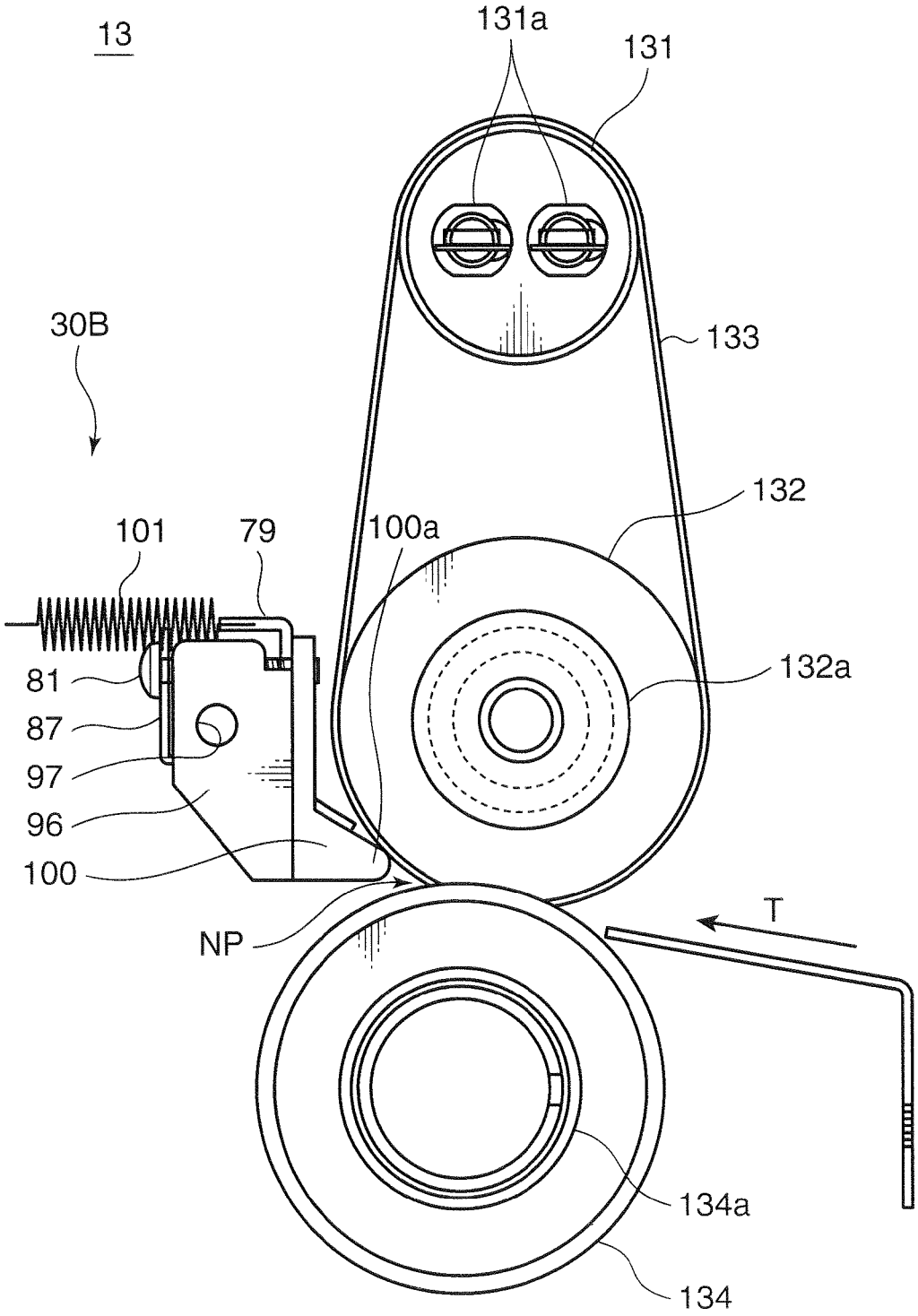
FIG. 8 is a front view explanatory diagram for describing main components of the fixing device according to a second embodiment.
Figure 9:
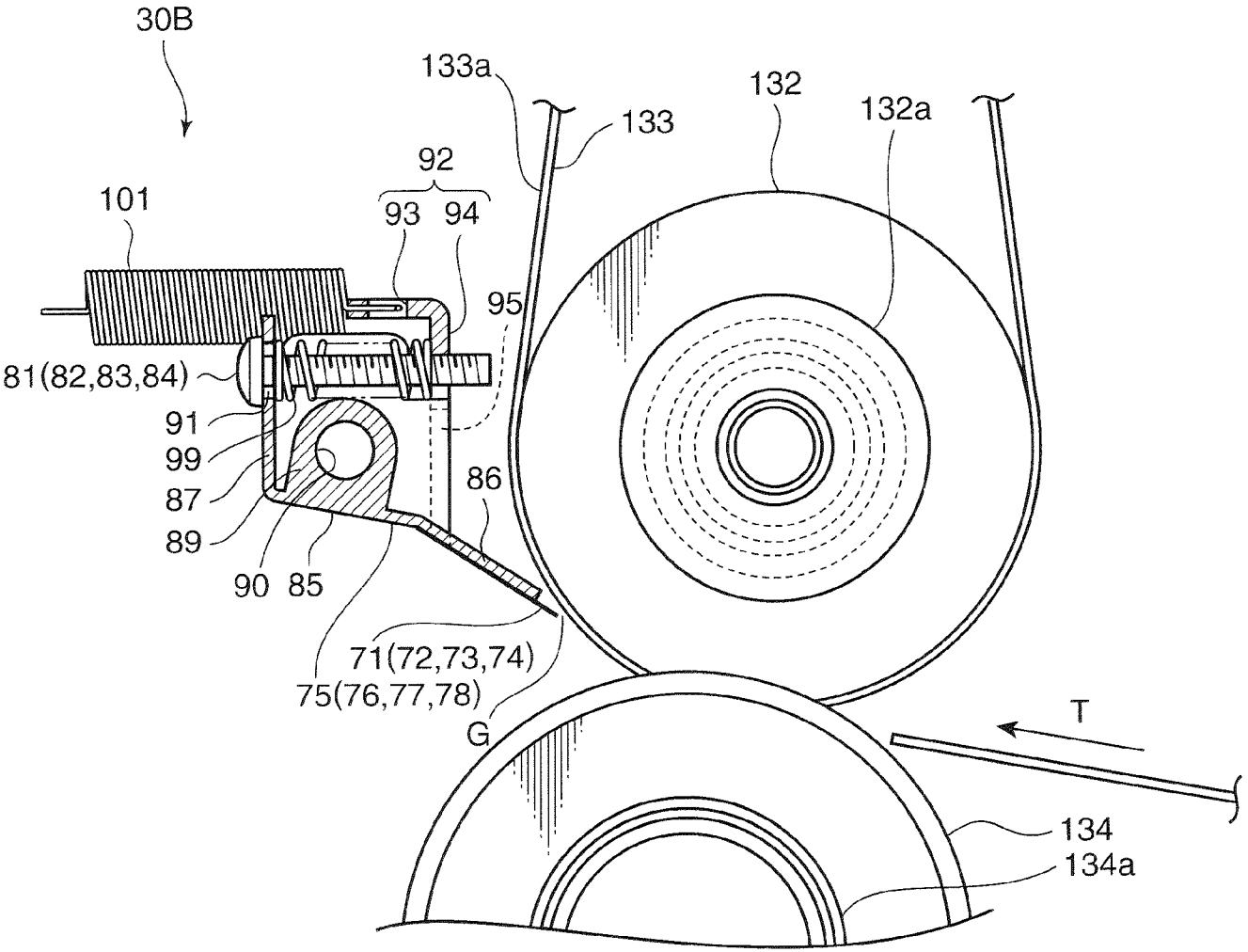
FIG. 9 is a front cross-sectional view explanatory diagram of the separation mechanism, which is one principal component of the fixing device shown in FIG. 8.
Figure 10:
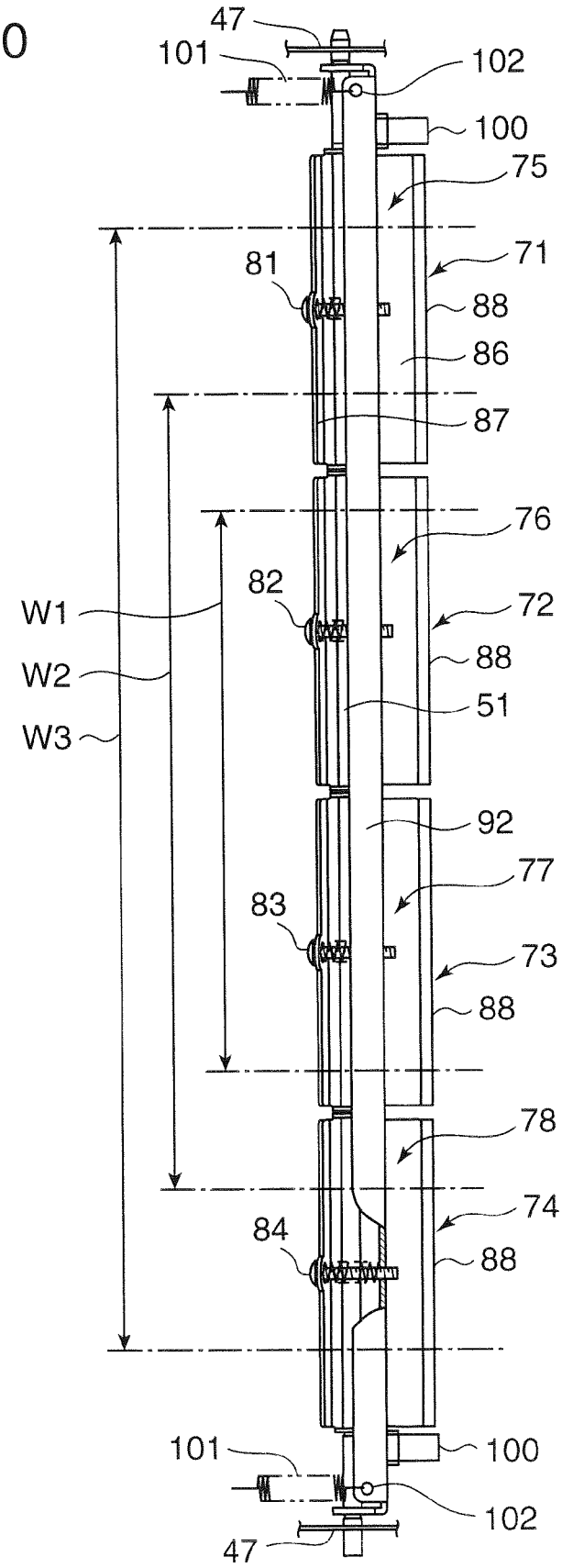
FIG. 10 is a top view of the separation mechanism.
Figure 11:
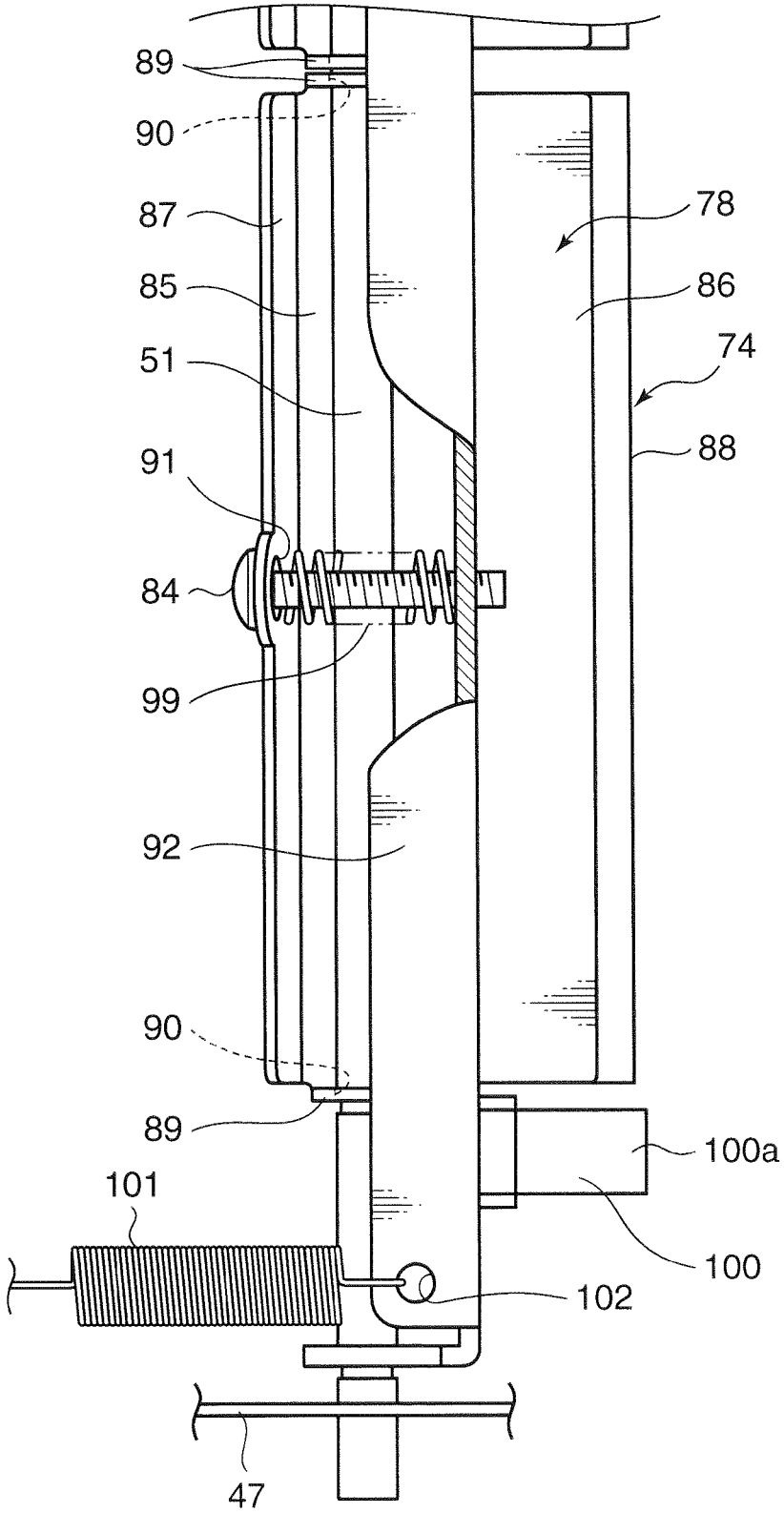
FIG. 11 is an enlarged top view of one portion of FIG. 10.

Hereinafter, description is given with reference to FIG. 8 to FIG. 11 regarding the fixing device 13 according to a second embodiment, and particularly in regard to a separation mechanism 30B. FIG. 8 is a front view explanatory diagram for describing main components of the fixing device 13 according to the second embodiment. FIG. 9 is a front cross-sectional view of the separation mechanism 30B, which is one of the principal components of the fixing device 13 shown in FIG. 8. FIG. 10 is a top view of the separation mechanism 30B, and FIG. 11 is an enlarged top view of one portion of FIG. 10.

The fixing device 13 includes the heating roller 131, the fixing roller 132, the fixing belt 133, which is provided spanning between the heating roller 131 and the fixing roller 132, the pressing roller 134, which is arranged in opposition to the fixing roller 132 through the fixing belt 133, and a separation mechanism 30B, which is arranged in opposition to the fixing roller 132 through the fixing belt 133. The heating roller 131, the fixing roller 132, the fixing belt 133, and the pressing roller 134 are equivalent configurations to the first embodiment and therefore description thereof is omitted.

The separation mechanism 30B is provided with a plurality of separation plates (separation members) 71 to 74 that are arranged along the longitudinal direction of the fixing roller 132 leaving a predetermined gap between each other, a plurality of separation plate holders 75 to 78, on which the corresponding separation plates 71 to 74 are attached, a plurality of gap adjustment members 81 to 84, which are provided corresponding to the separation plate holders 75 to 78 and cause the corresponding separation plate holders 75 to 78 to rotate, a support member 79 that supports the separation plate holders 75 to 78 and the gap adjustment members 81 to 84, and a main body frame 47 that supports the separation plate holders 75 to 78 and the support member 79.

As shown in FIG. 10, in the second embodiment also, the four separation plate holders (first to fourth separation plate holders 75 to 78) are arrayed in the longitudinal direction of the fixing roller 132 (vertical direction in FIG. 10). Each of the separation plate holders 75 to 78 is a member whose cross section as viewed from the longitudinal direction of the fixing roller 132 forms a substantial L shape (FIG. 9), and is provided with a rectangular holder main body portion 85 that extends along the longitudinal direction of the fixing roller 132, a support portion 86 that extends diagonally downward from one edge (right edge in FIG. 9) in the longitudinal direction of the holder main body portion 85 toward the fixing belt 133, and a rising wall (extended portion) 87 that rises upward from the other edge (left edge in FIG. 9), which is positioned on an opposite side to the other edge. It should be noted that in FIG. 10, dimensions of the first to fourth separation plate holders 75 to 78 are set substantially equivalent, but these may be different from each other.

Corresponding first to fourth separation plates 71 to 74 are attached at a bottom surface of each holding section 86 of the first to fourth separation plate holders 75 to 78. Each of the first to fourth separation plates 71 to 74 is set having a thickness of approximately 0.2 mm and is a rectangular flat plate member on whose surface a fluororesin coating has been implemented. The first to fourth separation plates 71 to 74 are secured by welding for example to a lower surface of the corresponding holding section 86. The first to fourth separation plates 71 to 74 have an edge 88 (right edge in FIG. 10 and FIG. 11) that extends along the longitudinal direction of the fixing roller 132, and in a state in which the first to fourth separation plates 71 to 74 are secured to the corresponding holding section 86, the right edge 88 protrudes by a predetermined distance from the lower surface of the corresponding holding section 86 toward the peripheral surface of the fixing roller 132. And as shown in FIG. 9, each right edge 88 of the first to fourth separation plates 71 to 74 is in opposition to the surface 133*a* of the fixing belt 133 wound around the fixing roller 132 with a predetermined gap G, for example a gap of 0.3 to 0.5 mm. In a same manner as the first to fourth separation plates 31 to 34 of the first embodiment, with the thus-configured first to fourth separation plates 71 to 74, in a case where a paper that has passed through the nip area NP and is discharged from the nip area NP while stuck to the surface 133*a* of the fixing belt 133, the paper can be stripped from the surface 133*a* of the fixing belt 133 by the right edges 88 contacting the paper that is stuck to the fixing belt 133.

Furthermore, each holder main body portion 85 of the first to fourth separation plate holders 75 to 78 is provided with a front edge and a rear edge that are in opposition to each other in the longitudinal direction of the holder main body portions 85. A pivot support wall 89 that rises upwardly is provided at the front edge and the rear edge respectively, and a pivot support hole 90, through which the common pivot shaft 51 is inserted, is formed at each of the pivot support walls 89. The pivot support holes 90 of the holder main body portions 85 of the first to fourth separation plate holders 75 to 78 are set so as to be on the same axis. Accordingly, in a state in which the common pivot shaft 51 is inserted through all the pivot support holes 90, the first to fourth separation plate holders 75 to 78 are able to rotate centered on the common pivot shaft 51. As shown in FIG. 10 and FIG. 11, the common pivot shaft 51 is supported at both ends by the main body frame 47.

Figure 12:
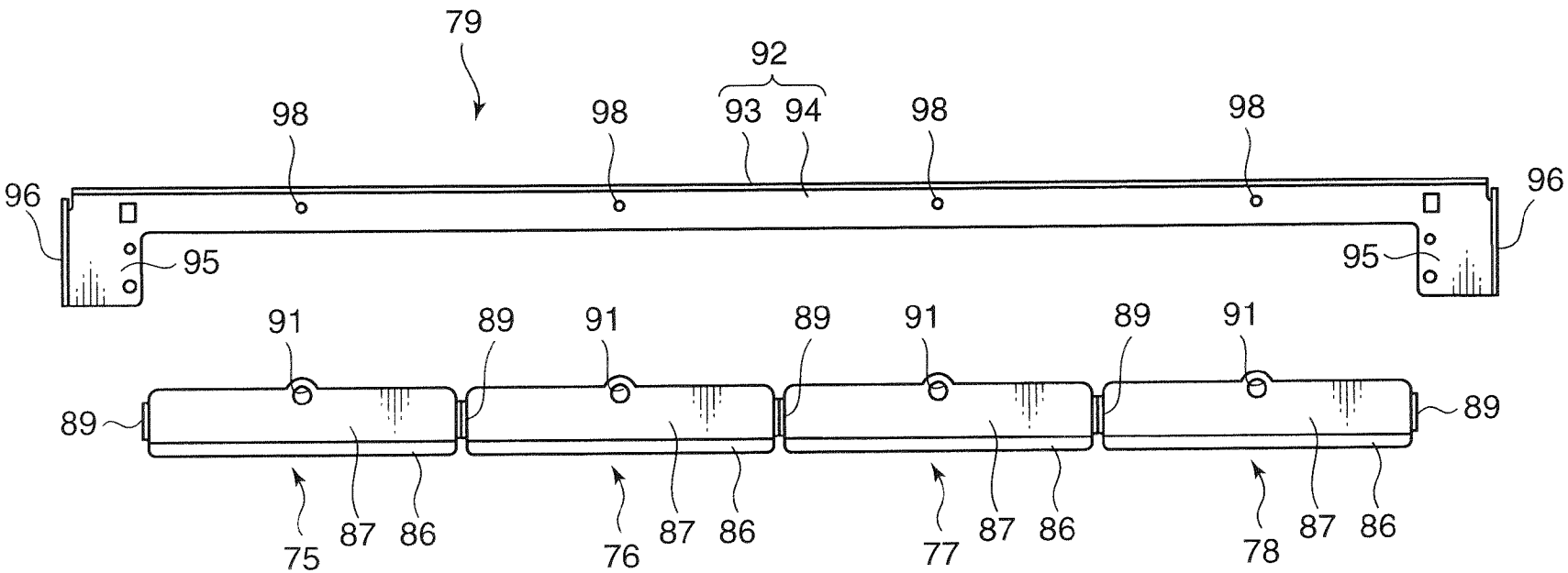
FIG. 12 is a diagram of the separation plate holders and support members of the separation mechanism as viewed from the left side in FIG. 9.

Further still, as shown in FIG. 12, the rising walls 87 of the first to fourth separation plate holders 75 to 78 are provided with pass-through holes 91, which are formed in the vicinity of an upper edge thereof. The corresponding first to fourth gap adjustment members 81 to 84 are rotatably inserted into these pass-through holes 91. The first to fourth gap adjustment members 81 to 84 are screw members in a same manner as the first embodiment.

As shown in FIG. 8 and FIG. 9, the support member 79, which supports the first to fourth separation plate holders 75 to 78 and the first to fourth gap adjustment members 81 to 84, includes a main body portion 92 whose cross section as viewed from the longitudinal direction of the fixing roller 132 forms a substantial L shape. The main body portion 92 is provided with a long narrow top wall 93 that extends along the longitudinal direction of the fixing roller 132, and a support wall 94, which extends downward from an edge (right edge in FIG. 8) extending in the longitudinal direction of the top wall 93.

As shown in FIG. 12, attachment walls 95 that extend further downward than the support wall 94 are provided at ends in the longitudinal direction of the support wall 94. The attachment walls 95 are provided with a right surface facing the fixing roller 132 and a left surface facing a direction opposite to the right surface, and pivot support walls 96 that protrude leftward are provided at the left surfaces.

Pivot support holes 97, which are set on the same axis as each other and which are set on the same axis as the pivot support holes 90 of the first to fourth separation plate holders 75 to 78, are formed at the pair of pivot support walls 96. Accordingly, in a state in which the common pivot shaft 51 is inserted into the pivot support holes 97 of the support member 79 and the pivot support holes 90 of the first to fourth separation plate holders 75 to 78, the support member 79 can rotate on the same shaft as the first to fourth separation plate holders 75 to 78.

Four pass-through holes 98 are formed in the support wall 94 with a predetermined gap in the longitudinal direction. In a state in which the support member 79 and the first to fourth separation plate holders 75 to 78 are assembled together, the four pass-through holes 98 of the support wall 94 are set in position so as to be on the same shaft as the pass-through holes 91 of the corresponding first to fourth separation plate holders 75 to 78. And the ends of the first to fourth gap adjustment members 81 to 84, which pass through the pass-through holes 91 of the first to fourth separation plate holders 75 to 78, that is, the tip portions of the first to fourth screw members 81 to 84, are rotatably supported in the corresponding pass-through holes 98 of the support wall 94. Furthermore, the shaft portions of the first to fourth gap adjustment members 81 to 84 are rotatably supported in the pass-through holes 91 of the first to fourth separation plate holders 75 to 78. In this manner, the first to fourth gap adjustment members 81 to 84 are supported by the support member 79 and the first to fourth separation plate holders 75 to 78.

Furthermore, spring members 99 are fitted freely on the shaft portions of the first to fourth screw members 81 to 84. The spring members 99 are arranged such that one end thereof contacts the rising wall 87 of the corresponding first to fourth separation plate holders 75 to 78, and the other end contacts the support wall 94 of the support member 79. For this reason, the rising walls 87 of the first to fourth separation plate holders 75 to 78 receive a biasing force so as to move apart from the support wall 94 of the support member 79. Due to the biasing force of the spring members 99, the first to fourth separation plate holders 75 to 78 1rotate centering on the common pivot shaft 51 (counterclockwise rotation in FIG. 9). Due to this counterclockwise rotation, the separation plates 71 to 74, which are secured at the separation plate holders 75 to 78, move toward the surface 133*a* of the fixing belt 133.

However, since the rising walls 87 of the first to fourth separation plate holders 75 to 78 and the support wall 94 of the support member 79 are linked by the corresponding first to fourth gap adjustment members 81 to 84, specifically, by suitably adjusting the respective rotation amounts of the first to fourth gap adjustment members 81 to 84, the biasing force of the spring member 99 can be controlled by adjusting the distance between the rising walls 87 of the first to fourth separation plate holders 75 to 78 and the support wall 94 of the support member 79, and therefore counterclockwise rotation of first to fourth separation plate holders 75 to 78 is allowed only in a predetermined range, and along with this, movement of the first to fourth separation plates 71 to 74 also is allowed only in a predetermined range. In this manner, the gaps G between each of the first to fourth separation plates 71 to 74 and the surface 133*a* of the fixing belt 133 respectively can be maintained at a magnitude of the aforementioned range of 0.3 to 0.5 mm by controlling the rotation amount of the first to fourth separation plate holders 75 to 78.

Abutting members 100 are attached at right surfaces of the attachment walls 95 of the support member 79 so as to not interfere with the first separation plate 71 and the fourth separation plate 74. Each of the abutting members 100 is provided with a free end 100*a*, which is set in position at a height substantially equivalent to the first to fourth separation plates 71 to 74 as viewed from the longitudinal direction of the fixing roller 132. The free ends 100*a* of the abutting members 100 protrude rightward from the right edge 88 of the first to fourth separation plates 71 to 74 and are held in contact with longitudinal ends of the fixing roller 132 (in face, width direction ends of the fixing belt 133) by the biasing member 101.

The biasing member 101 is constituted by two spring members arranged at a left side of the support member 79 as shown in FIG. 9, at positions corresponding to the longitudinal ends of the top wall 93 of the support member 79. Engagement holes 102 are formed at longitudinal ends respectively of the top wall 93. One end of each spring member 101 is engaged into the engagement hole 102, and the other end is latched to an unshown predetermined member of the fixing device. Due to these spring members 101, the support member 79 is pulled leftward by way of the top wall 93 and rotates centering on the common pivot shaft 51, and therefore the free end 100*a* of the abutting member 100 is held in contact with the fixing roller 132 through the fixing belt 133. An effect of the abutting members 100 is equivalent to the abutting members 59 of the first embodiment, and therefore description thereof is omitted.

Furthermore, in the second embodiment also, occurrences of paper jam by the paper stuck in the gaps between the first to fourth separation plates 71 to 74 are prevented by carrying out the position settings of the first to fourth separation plates 71 to 74 according to the minimum paper region W1, the intermediate paper region W2, and the maximum paper region W3 in the same manner as the first embodiment, and therefore description thereof is omitted.

In the same manner as the separation mechanism 30A of the first embodiment, with the thus-configured separation mechanism 30B, the first to fourth gap adjustment members 81 to 84 are provided for the first to fourth separation plates 71 to 74 respectively, and therefore the first to fourth separation plates 71 to 74 can be moved individually with respect to the fixing belt 133 so that the gaps G between the first to fourth separation plates 71 to 74 and the surface 133*a* of the fixing belt 133 respectively achieve a magnitude in the range of 0.3 to 0.5 mm. As a result, adjustment of the gaps G between the separation plate (the first to fourth separation plates 71 to 74) and the surface 133*a* of the fixing belt 133 become easy compared to conventional configurations in which the gap between the separation plate and the fixing belt is adjusted by causing a plurality of screw members to contact a single separation plate.

In the above-described first embodiment and second embodiment according to the present invention, description has been given regarding a configuration in which the separation plates 31 to 34 and 71 to 74 are adjacent, but it is not absolutely necessary for the separation plates 31 to 34 and 71 to 74 to be adjacent. Furthermore, description has been given regarding a configuration in which screw members are used as the gap adjustment members, but instead of screw members, it is also possible to employ a configuration in which pressure is performed using an eccentric cam for example.

It is preferable that the above-described image forming apparatus according to the present embodiment, and in particular the fixing device used in such image forming apparatuses, has a configuration that is indicated hereinafter.

A fixing device according to the present embodiment includes a fixing member, a pressing member held in contact with the fixing member to form a nip area therebetween, the fixing member and the pressing member operable to sandwich a paper, on which a toner image has been formed, at the nip area and fix the toner image onto the paper, and a separation mechanism arranged on a downstream side of the fixing member in a convey direction of the paper and capable of stripping from the fixing member the paper that has undergone a fixing process. The fixing member has a first region and a second region set in a direction orthogonal to the convey direction of the paper. The separation mechanism includes a first separation member arranged opposite the first region in a state apart from the first region by a first gap, a second separation member arranged opposite the second region in a state apart from the second region by a second gap and at a position different from that of the first separation member in a direction orthogonal to the convey direction of the paper, a first gap adjustment member capable of moving the first separation member relative to the first region of the fixing member to adjust the first gap, and a second gap adjustment member capable of moving the second separation member relative to the second region of the fixing member to adjust the second gap.

With a fixing device of the above-described configuration, the first gap adjustment member and the second gap adjustment member are provided for the first separation member and the second separation member respectively, and therefore the first separation member and the second separation member can be moved individually with respect to the fixing member so that the first gap between the first separation member and the first region of the fixing member and the second gap between the second separation member and the second region of the fixing member achieve a predetermined magnitude. As a result, adjusting the gap between the separation member and the fixing member becomes easy compared to conventional configurations in which a plurality of gap adjustment members are provided for a single separation member.

With the fixing device of the above-described configuration, it is preferable that: the fixing member has a plurality of regions including the first region and the second region, a plurality of separation members including the first separation member and the second separation member are arrayed adjacently in the orthogonal direction and arranged opposite corresponding regions with predetermined gaps formed therebetween, and a plurality of gap adjustment members including the first gap adjustment member and the second gap adjustment member are arranged corresponding to the separation members.

With this configuration, the plurality of separation members including the first separation member and the second separation member are arrayed adjacent to each other in the orthogonal direction, and a plurality of regions to which the separation members correspond are provided on the fixing member, and therefore the gaps between the separation members and the fixing member can be set in a plurality of locations. In this way, fine adjustments of the gaps can be performed in the orthogonal direction.

With the fixing device of the above-described configuration, it is preferable that: the separation mechanism further includes a plurality of separation member holders on which the corresponding separation members are attached and which are so rotatable as to move the separation members towards or away from the fixing member, and the gap adjustment members are provided corresponding to the separation member holders respectively, and rotate the corresponding separation member holders to move the separation members relative to the fixing member.

With this configuration, settings of the gaps between the separation members and the fixing member can be carried out easily by determining a range of rotation of the separation member holders using the gap adjustment members.

With the fixing device of the above-described configuration, it is preferable that: the separation mechanism further includes a support member supporting the plurality of gap adjustment members, the gap adjustment members are screw members rotatably supported by the support member, and the separation member holders are configured so as to rotate along with rotation of the screw members.

With this configuration, the separation member holders on which the separation members are attached are rotatable accompanying rotation of the corresponding screw members, and therefore by determining the range of rotation of the separation plate holders by adjusting the rotation amounts of the screw members, settings of the predetermined gaps can be carried out easily.

With the fixing device of the above-described configuration, it is preferable that: the fixing member is a fixing belt extending in a direction orthogonal to the convey direction of the paper, the pressing member is a roller member extending in a direction orthogonal to the convey direction and forming the nip area with the fixing belt in the orthogonal direction, the separation mechanism further includes a main body frame rotatably supporting the support member on the same axis as the plurality of separation member holders, an abutting member is attached to the support member in addition to the screw members, and the abutting member is held in contact with longitudinal ends of the fixing belt in which the regions are not formed.

With this configuration, the support member on which the abutting members are attached is rotatably supported by the main body frame, and the abutting members contact the longitudinal ends of the fixing belt, and therefore even in a case where the fixing belt undergoes thermal expansion or oscillation during the fixing process, the abutting members are able to rotate following the deformation of the fixing belt caused by the thermal expansion or oscillation. Due to this, the gaps between the separation members and the fixing belt can be maintained at a predetermined magnitude.

With the fixing device of the above-described configuration, it is preferable that: the fixing member is a fixing belt extending in a direction orthogonal to the convey direction of the paper, the pressing member is a roller member extending in a direction orthogonal to the convey direction and forming the nip area with the fixing belt in the orthogonal direction, the nip area has a paper passing region, through which the papers pass, defined according to a size of the papers measured in the longitudinal direction of the fixing belt, the plurality of separation members, adjoining one another, each have ends, with one end of the separation member opposing one end of the adjoining separation member in the longitudinal direction of the fixing belt with a gap formed therebetween, and of the adjoining separation members, one end of the separation member and one end of the adjoining separation member are set at positions corresponding to positions displaced from the longitudinal ends of the paper passing region.

With this configuration, of the adjacent separation members, one end of the separation member and one end of the adjacent separation member, which ends are opposed to each other in the longitudinal direction of the fixing belt through the gap, are set at positions corresponding to positions displaced from the longitudinal ends of the paper passing region, which is set in the nip area, and therefore it is possible to prevent a paper, which has passed through the nip area and is being conveyed, from being stuck in the gap between the opposed ends of the adjacent separation members. In this way, occurrences of paper jams can be prevented.

With the fixing device of the above-described configuration, it is preferable that: the separation mechanism further includes a main body frame supporting rotatably the support member and the plurality of separation member holders in a coaxial manner, and a plurality of spring members arranged between the support member and each of the separation member holders, each of the separation member holders has a holder main body portion to which the separation member is attached, and an extended portion extending from the holder main body portion and with which a tip portion of the screw member is held in contact, and a biasing force of the spring member pulls the extended portion of the separation member holder towards the support member to rotate the holder main body portion towards the fixing member.

With the fixing device of the above-described configuration, it is preferable that: the separation mechanism further includes a main body frame supporting rotatably the plurality of separation member holders in a coaxial manner, and a plurality of spring members arranged between the support member and each of the separation member holders, the support member rotatably supports the tip portions of the screw members, each of the separation member holders has a holder main body portion to which the separation members are attached, and an extended portion extending from the holder main body portion and rotatably supporting a shaft portion of the screw member, and a biasing force of the spring member separates the extended portion of the separation member holder from the support member to rotate the holder main body portion towards the fixing member.

This application is based on Japanese Patent Application Serial No. 2009-044266, filed in Japan Patent Office on Feb. 26, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A fixing device, comprising:

a fixing member having at least first and second regions set in a direction orthogonal to a convey direction of a paper;

a pressing member held in contact with the fixing member to form a nip area therebetween, the fixing member and the pressing member operable to sandwich the paper, on which a toner image has been formed, at the nip area and fix the toner image onto the paper, and a separation mechanism arranged on a downstream side of the fixing member in the convey direction of the paper and capable of stripping from the fixing member the paper that has undergone a fixing process, the separation mechanism including:

a main body frame;

a shaft supported on the main body frame and extending in the direction orthogonal to the convey direction;

a support member supported on the shaft for rotation about an axis of the shaft;

at least first and second separation member holders supported on the shaft for rotation about the axis of the shaft, each of the separation member holders having a holder main body and an extended portion extending from the holder main body;

a first separation member attached to the holder main body of the first separation member holder and arranged opposite the first region of the fixing member in a state apart from the first region by a first gap, rotation of the first separation member holder about the axis of the shaft moving the first separation member toward or away from the fixing member;

a second separation member attached to the holder main body of the second separation member holder and arranged opposite the second region of the fixing member in a state apart from the second region by a second gap and at a position substantially adjacent the first separation member in the direction orthogonal to the convey direction of the paper with a predetermined space between the first and second separation members, rotation of the second separation member holder about the axis of the shaft moving the second separation member toward or away from the fixing member;

springs arranged between the support member and each of the separation member holders, the springs exerting biasing forces to urge the extended portion of the respective separation member holder toward the support member and to rotate the holder main body of the respective separation member holder toward the fixing member;

a first gap adjustment screw rotatably supported by the support member and having a tip held in contact with the extended portion of the holder main body of the first separation member so that rotation of the first gap adjustment screw moves the tip and causes the first separation member to rotate around the shaft and relative to the first region of the fixing member to adjust the first gap; and a second gap adjustment screw rotatably supported by the support member and having a tip held in contact with the extended portion of the holder main body of the second separation member so that rotation of the first gap adjustment screw moves the tip and causes the second separation member to rotate around the shaft and relative to the second region of the fixing member to adjust the second gap.

2. The fixing device according to claim 1, wherein the fixing member is a fixing belt extending in the direction orthogonal to the convey direction of the paper, the pressing member is a roller member extending in the direction orthogonal to the convey direction and forming the nip area with the fixing belt in the orthogonal direction, an abutting member is attached to the support in addition to the screws, and the abutting member is held in contact with longitudinal ends of the fixing belt in which the regions are not formed.

3. A fixing device, comprising:

a fixing belt extending in a direction orthogonal to a convey direction of a paper and having a plurality of regions including first and second regions set in the direction orthogonal to the convey direction of the paper, a pressing roller extending in the direction orthogonal to the convey direction and held in contact with the fixing belt to form a nip area with the fixing belt in the direction orthogonal to the convey direction, the fixing belt and the pressing roller being operable to sandwich the paper, on which a toner image has been formed, at the nip area and fixing the toner image onto the paper, the nip area having a paper passing region, through which the papers pass, defined according to a size of the papers measured in a longitudinal direction of the fixing belt; and a separation mechanism arranged on a downstream side of the fixing belt in the convey direction of the paper and capable of stripping from the fixing belt the paper that has undergone a fixing process, the separation mechanism including:

a first separation member arranged opposite the first region in a state apart from the first region by a first gap;

a second separation member arranged opposite the second region in a state apart from the second region by a second gap and at a position different from that of the first separation member in the direction orthogonal to the convey direction of the paper;

the first and second separation members adjoining one another so that one end of the first separation member is opposed to one end of the second separation member in the longitudinal direction of the fixing belt with a gap formed therebetween, the opposed ends of the first and second separation members being set at positions displaced from the longitudinal ends of the paper passing region;

a first gap adjustment member capable of moving the first separation member relative to the first region of the fixing member to adjust the first gap; and a second gap adjustment member capable of moving the second separation member relative to the second region of the fixing member to adjust the second gap; and the first and second gap adjustment members are arranged corresponding to the separation members.

4. A fixing device, comprising:

a fixing member having first and second regions set in a direction orthogonal to a convey direction of a paper;

a pressing member held in contact with the fixing member to form a nip area therebetween, the fixing member and the pressing member operable to sandwich the paper, on which a toner image has been formed, at the nip area and fix the toner image onto the paper, and a separation mechanism arranged on a downstream side of the fixing member in a convey direction of the paper and capable of stripping from the fixing member the paper that has undergone a fixing process, the separation mechanism including:

a main body frame;

a shaft supported on the main body frame and extending in the direction orthogonal to the convey direction;

a support member supported on the shaft for rotation about an axis of the shaft;

at least first and second separation member holders supported on the shaft for rotation about the axis of the shaft, each of the separation member holders has a holder main body and an extended portion extending from the holder main body;

a first separation member attached to the holder main body of the first separation member holder and arranged opposite the first region of the fixing member in a state apart from the first region by a first gap;

a second separation member attached to the holder main body of the second separation member holder and arranged opposite the second region of the fixing member in a state apart from the second region by a second gap and at a position substantially adjacent the first separation member with a predetermined space between the first and second separation members in the direction orthogonal to the convey direction of the paper;

a plurality of spring members arranged between the support member and each of the separation member holders;

first and second gap adjustment screws corresponding to the respective first and second separation member holders, each of the gap adjustment screws having a shaft portion and a tip portion, the support member rotatably supporting the tip portions of the gap adjustment screws the extended portion of the respective separation member holder rotatably supporting the shaft portion of the respective gap adjustment screw, wherein:

the separation member holders rotate around the shaft in response to rotation of respective gap adjustment screws to adjust the respective gaps between the separation members and the fixing member, and biasing forces of the spring members separate the extended portions of the respective separation member holders from the support member to rotate the respective holder main body toward the fixing member.

5. An image forming apparatus, comprising:

an image forming section forming a toner image on a paper; and a fixing device fixing the toner image onto the paper, the fixing device including:

a fixing member having at least first and second regions set in a direction orthogonal to a convey direction of a paper;

a pressing member held in contact with the fixing member to form a nip area therebetween, the fixing member and the pressing member operable to sandwich the paper, on which a toner image has been formed, at the nip area and fix the toner image onto the paper, and a separation mechanism arranged on a downstream side of the fixing member in the convey direction of the paper and capable of stripping from the fixing member the paper that has undergone a fixing process, the separation mechanism including:

a main body frame;

a shaft supported on the main body frame and extending in the direction orthogonal to the convey direction;

a support member supported on the shaft for rotation about an axis of the shaft;

at least first and second separation member holders supported on the shaft for rotation about the axis of the shaft, each of the separation member holders has a holder main body and an extended portion extending from the holder main body;

a first separation member attached to the holder main body of the first separation member holder and arranged opposite the first region of the fixing member in a state apart from the first region by a first gap, rotation of the first separation member holder about the axis of the shaft moving the first separation member toward or away from the fixing member;

a second separation member attached to the holder main body of the second separation member holder and arranged opposite the second region of the fixing member in a state apart from the second region by a second gap and at a position substantially adjacent the first separation member in the direction orthogonal to the convey direction of the paper with a predetermined space between the first and second separation members, rotation of the second separation member holder about the axis of the shaft moving the second separation member toward or away from the fixing member;

springs arranged between the support member and each of the separation member holders, the springs exerting biasing forces to urge the extended portion of the respective separation member holder toward the support and to rotate the holder main body of the respective separation member holder toward the fixing member;

a first gap adjustment screw rotatably supported by the support and having a tip held in contact with the extended portion of the holder main body of the first separation member so that rotation of the first gap adjustment screw moves the tip and causes the first separation member to rotate around the shaft and relative to the first region of the fixing member to adjust the first gap; and a second gap adjustment screw rotatably supported by the support and having a tip held in contact with the extended portion of the holder main body of the second separation member so that rotation of the first gap adjustment screw moves the tip and causes the second separation member to rotate around the shaft and relative to the first region of the fixing member to adjust the second gap.

6. The image forming apparatus according to claim 5, wherein the fixing member is a fixing belt extending in the direction orthogonal to the convey direction of the paper, the pressing member is a roller member extending in a direction orthogonal to the convey direction and forming the nip area with the fixing belt in the orthogonal direction, an abutting member is attached to the support member in addition to the screw members, and the abutting member is held in contact with longitudinal ends of the fixing belt in which the regions are not formed.

7. The image forming apparatus, comprising:

a fixing belt extending in a direction orthogonal to the convey direction of the paper and having a plurality of regions including first and second regions set in the direction orthogonal to the convey direction of the paper, a pressing roller extending in the direction orthogonal to the convey direction and held in contact with the fixing belt to form a nip area with the fixing belt in the direction orthogonal to the convey direction, the fixing belt and the pressing roller being operable to sandwich the paper, on which a toner image has been formed, at the nip area and fixing the toner image onto the paper, the nip area having a paper passing region, through which the papers pass, defined according to a size of the papers measured in the longitudinal direction of the fixing belt; and a separation mechanism arranged on a downstream side of the fixing belt in the convey direction of the paper and capable of stripping from the fixing belt the paper that has undergone a fixing process, the separation mechanism including:

a first separation member arranged opposite the first region in a state apart from the first region by a first gap;

a second separation member arranged opposite the second region in a state apart from the second region by a second gap and at a position different from that of the first separation member in the direction orthogonal to the convey direction of the paper;

the first and second separation members, adjoining one another so that one end of the first separation member is opposed to one end of the second separation member in the longitudinal direction of the fixing belt with a gap formed therebetween, and the opposed ends of the first and second separation members being set at positions displaced from the longitudinal ends of the paper passing region;

a first gap adjustment member capable of moving the first separation member relative to the first region of the fixing member to adjust the first gap; and a second gap adjustment member capable of moving the second separation member relative to the second region of the fixing member to adjust the second gap; and the first and second gap adjustment members are arranged corresponding to the separation members.

8. An image forming apparatus, comprising:

an image forming section forming a toner image on a paper; and a fixing device fixing the toner image onto the paper, the fixing device including:

a fixing member having first and second regions set in a direction orthogonal to a convey direction of a paper;

a pressing member held in contact with the fixing member to form a nip area therebetween, the fixing member and the pressing member operable to sandwich the paper, on which a toner image has been formed, at the nip area and fix the toner image onto the paper, and a separation mechanism arranged on a downstream side of the fixing member in a convey direction of the paper and capable of stripping from the fixing member the paper that has undergone a fixing process, the separation mechanism including:

a main body frame;

a shaft supported on the main body frame and extending in the direction orthogonal to the convey direction;

a support member supported on the shaft for rotation about an axis of the shaft;

at least first and second separation member holders supported on the shaft for rotation about the axis of the shaft, each of the separation member holders has a holder main body and an extended portion extending from the holder main body;

a first separation member attached to the holder main body of the first separation member holder and arranged opposite the first region of the fixing member in a state apart from the first region by a first gap;

a second separation member attached to the holder main body of the second separation member holder and arranged opposite the second region of the fixing member in a state apart from the second region by a second gap and at a position substantially adjacent the first separation member with a predetermined space between the first and second separation members in the direction orthogonal to the convey direction of the paper;

a plurality of spring members arranged between the support member and each of the separation member holders;

first and second gap adjustment screws corresponding to the respective first and second separation member holders, each of the gap adjustment screws having a shaft portion and a tip portion, the support member rotatably supporting the tip portions of the gap adjustment screws the extended portion of the respective separation member holder rotatably supporting the shaft portion of the respective gap adjustment screw, wherein:

the separation member holders rotate around the shaft in response to rotation of respective gap adjustment screws to adjust the respective gaps between the separation members and the fixing member, and biasing forces of the spring members separate the extended portions of the respective separation member holders from the support member to rotate the respective holder main body toward the fixing member.

* * * * *